US006554061B2

(12) United States Patent
Jukkola et al.

(10) Patent No.: US 6,554,061 B2
(45) Date of Patent: Apr. 29, 2003

(54) RECUPERATIVE AND CONDUCTIVE HEAT TRANSFER SYSTEM

(75) Inventors: Glen D. Jukkola, Glastonbury, CT (US); Paul R. Thibeault, Windsor, CT (US); Michael S. McCartney, Bloomfield, CT (US)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/740,356

(22) Filed: Dec. 18, 2000

(65) Prior Publication Data

US 2002/0124996 A1 Sep. 12, 2002

(51) Int. Cl.[7] ..... F28D 13/00

(52) U.S. Cl. ..... 165/104.16; 165/104.11; 165/104.15

(58) Field of Search ..... 95/109; 165/1, 165/104.16, 108, 119; 122/4 D; 422/145–147; 110/245

(56) References Cited

U.S. PATENT DOCUMENTS

| | | | | |
|---|---|---|---|---|
| 2,818,049 A | | 12/1957 | Blaskowski et al. | |
| 2,983,259 A | | 5/1961 | Whittke | |
| 2,997,031 A | | 8/1961 | Ulmer | |
| 3,101,697 A | | 8/1963 | Hunter | |
| 3,115,925 A | | 12/1963 | Ulmer et al. | |
| 3,119,378 A | | 1/1964 | Marshall | |
| 4,227,488 A | * | 10/1980 | Stewart et al. | 122/4 D |
| 4,325,327 A | | 4/1982 | Kantesaria et al. | |
| 4,335,662 A | | 6/1982 | Jones | |
| 4,360,339 A | | 11/1982 | Blaskowski | |
| 4,427,053 A | * | 1/1984 | Klaren | 165/1 |
| 4,445,844 A | | 5/1984 | Matthews | |
| 4,539,939 A | | 9/1985 | Johnson | |
| 4,633,818 A | | 1/1987 | Holitz, Jr. et al. | |
| 4,750,543 A | * | 6/1988 | Edelstein | 165/1 |
| 4,753,180 A | * | 6/1988 | Narisoko et al. | 110/346 |
| 5,039,395 A | * | 8/1991 | Martin et al. | 208/127 |
| 5,064,444 A | * | 11/1991 | Kubiak et al. | 48/202 |
| 5,099,801 A | * | 3/1992 | Scholl | 122/4 D |
| 5,190,451 A | * | 3/1993 | Goldbach | 431/5 |
| 5,346,515 A | * | 9/1994 | Kubiak et al. | 48/73 |
| 5,401,130 A | | 3/1995 | Chiu et al. | |
| 5,415,684 A | * | 5/1995 | Anderson | 95/109 |
| 5,441,704 A | * | 8/1995 | Grochowski | 422/145 |

FOREIGN PATENT DOCUMENTS

| | | | | |
|---|---|---|---|---|
| DE | 2152401 | * | 10/1973 | F27B/15/00 |
| JP | 405256586 A | * | 10/1993 | F28D/13/00 |

* cited by examiner

*Primary Examiner*—Henry Bennett
*Assistant Examiner*—Nihir Patel
(74) *Attorney, Agent, or Firm*—Russell W. Warnock

(57) ABSTRACT

A recuperative and conductive heat transfer system (10, 10') that is operative to effect therewith the heating within the second portion (20, 20') of the heat transfer system (10, 10') of a "working fluid" flowing through the heat s transfer surfaces (32, 32') as a consequence of the transfer thereto by conduction of heat from a multiplicity of regenerative solids (24, 24'). The multiplicity of regenerative solids (24, 24') derive their heat from a recuperation thereby within the first portion (12, 12') of the heat transfer system (10, 10') from either an internally generated or an externally generated source of heat (22, 22').

17 Claims, 4 Drawing Sheets

RECUPERATIVE AND CONDUCTIVE HEAT TRANSFER SYSTEM

BACKGROUND OF THE INVENTION

This invention relates to heat transfer systems, and more specifically, to a recuperative and conductive heat transfer system that is operative to effect therewith the heating of a "working fluid" by means of the transfer of heat from hot regenerative solids to the "working fluid". The term "working fluid" as employed herein is intended to refer to the "working fluid" of a thermodynamic cycle, e.g., steam or ammonia, as well as to a process feedstock. The source of heat by means of which the hot regenerative solids themselves become heated may take many forms with the most prevalent of those commonly being that of an internal heat source, e.g., being that of the hot gases, which are produced as the result of the combustion of fuel and air in some type of combustion chamber. However, this source of heat could also be in the form of an external heat source, e.g., be in the form of the hot gas exhaust from a turbine or other similar piece of equipment, or could be in the form of a hot process stream, which is produced as a consequence of some kind of chemical reaction.

With further reference to the matter of internal heat sources, furnaces for firing fossil fuels have long been employed as a device for generating controlled heat with the objective of doing useful work. To this end, the work application might he in the form of direct work, as with rotary kilns, or might be in the form of indirect work, as with steam generators for industrial or marine use or for the generation of electric power. A further differentiation, insofar as such furnaces is concerned, is whether the furnace enclosure is cooled, such as with waterwalls, or uncooled, such as with a refractory lining.

It is believed that such furnaces developed originally from a need to fire pottery, around 4000 B. C., and a need to smelt copper, in or about 3000 B. C. Hastening and improving combustion by the use of bellows to blow air into the furnace is believed to have occurred in about 2000 B. C.

Closely associated with such furnaces is the corresponding steam boiler. Such boilers appear to be of Greek and Roman origin and were employed for household services. The Pompeiian water boiler, incorporating the water-tube principle, is one of the earliest recorded instances, i.e., in approximately 130 B. C., of boilers doing mechanical work. To this end, the Pompeiian water boiler sent steam to Hero's engine, a hollow sphere mounted and revolving on trunnions, one of which permitted the passage of steam, which was exhausted through two right-angled nozzles that caused the sphere to rotate. This is considered by most people to have been the world's first reaction turbine.

For virtually the next 1600 years, furnaces in general and waterwall furnaces in particular were essentially a neglected technology. This can be partly ascribed to the fact that steam as a working.fluid had no application until the invention of the first commercially successful steam engine by Thomas Savery in 1698. In 1705, Newcomen's engine followed and by 1711, this engine was in general use for pumping water out of coal mines. Self-regulating steam valves are believed to have first come into existence in 1713.

Many varieties of firetube boilers were invented in the second half of the $18^{th}$ century, culminating with the so-called Scotch marine boiler. As the name firetube boiler would imply, in the firetube boiler the tubes may be considered to be a component part of the furnace, with the combustion process-taking place within the tube bundles. However at the time, such units were limited, because of available steel-plate thicknesses, to operating pressures of about 150 psig. This was then followed by the development of the modem water-tube furnace for steam generation at higher pressures and in larger sizes than available with firetube boilers. Today, such modern water-tube furnaces for steam generation encompass all of the following: central-station steam generators, industrial boilers, fluidized-bed boilers, and marine boilers.

Of all of these various types of boilers, if it were necessary to classify the recuperative and conductive heat transfer system to which the present application is directed into one of these types of boilers, the recuperative and conductive heat transfer system to which the present application is directed, to the extent that an internal heat source is employed in connection with such a recuperative and conductive heat transfer system, would probably be considered to be more akin to a fluidized-bed boiler than to any of the aforementioned other various types of boilers. As such, the focus of the discussion hereinafter insofar as the prior art is concerned will thus be directed primarily to the fluidized-bed boiler type. To this end, fluidized-bed reactors have been used for decades in non-combustion reactions in which the thorough mixing and intimate contact of the reactants in a fluidized bed result in high product yield with improved economy of time and energy. Although other methods of burning solid fuels can generate energy with very high efficiency, fluidized-bed combustion can burn solid fuel efficiently at a temperature low enough to avoid many of the problems of combustion in other modes.

To those in the industry, it is well known that the word "fluidized" as employed in the term "fluidized-bed boiler" refers to the condition in which solid materials are given free-flowing fluid-like behavior. Namely, as a gas-is passed through a bed of solid particles, the flow of gas produces forces that tend to separate the particles from one another. At low gas flows, the particles remain in contact with other solids and tend to resist movement. This condition is commonly referred to as a fixed bed. On the other hand, as the gas flow is increased, a point is reached at which the forces on the particles are just sufficient to cause separation. The bed then becomes fluidized, that is, the gas cushion between the solids allows the particles to move freely, giving the bed a liquid-like characteristic.

The state of fluidization in a fluid-bed-boiler combustor depends mainly on the bed-particle diameter and fluidizing velocity. As such, there are essentially two basic fluid-bed combustion systems, each operating in a different state of fluidization. One of these two basic fluid-bed combustion systems is characterized by the fact that at relatively low velocities and with coarse bed-particle sizes, the fluid bed is dense, with a uniform solids concentration, and has a well-defined surface. This system is most commonly referred to by those in the industry as a bubbling fluid bed, because the air in excess of that required to fluidize the bed passes through the bed in the form of bubbles. The bubbling fluid bed is further characterized by modest bed solids mixing rates, and relatively low solids entrainment in the flue gas. While little recycle of the entrained material to the bed is needed to maintain bed inventory, substantial recycle rates may be used to enhance performance.

The other of these two basic fluid-bed combustion systems is characterized by the fact that at higher velocities and with finer bed-particle size, the fluid bed surface becomes diffuse as solids entrainment increases, such that there is no longer a defined bed surface. Moreover, recycle of entrained material to the bed at high rates is required in order to maintain bed inventory. The bulk density of the bed decreases with increasing height in the combustor. A fluidized-bed with these characteristics is most commonly referred to those by those in the industry as a circulating fluid bed because of the high rate of material circulating from the combustor to the particle recycle system and back to the combustor. The circulating fluid bed is further characterized by very high solids-mixing rates.

There are numerous examples to be found in the prior art of various forms of fluidized bed combustion systems, which have been devised over the course of time. Going back to as early as the late 1950's, an early example thereof, by way of exemplification and not limitation in this regard, is that which forms the subject matter of U.S. Pat. No. 2,818,049 entitled "Method of Heating", which issued on Dec. 31, 1957. In accordance with the teachings of U.S. Pat. No. 2,818,049, there is provided a method of transferring heat from a burning fluid involving the use of a fluidized pseudo-liquid bed of discrete material, which is an oxidizing catalyst and is continuously circulated by gravity through a predetermined path that includes an upflow column and a downflow column. Continuing, the subject method includes the steps of maintaining the bed in a fluidized pseudo-liquid state and the density of the upflow column substantially lower than the density of the downflow column by generating combustion gases in the upflow column through the introduction and burning of fuel therein, flowing the combustion gases upwardly through the upflow column, disengaging a portion of the combustion gases from the upflow column at the upper end of the upflow column, passing a fluid in indirect heat exchange relation with the bed at a location in the upflow column above the introduction and burning of fuel therein to impart heat thereto and maintaining the rate of circulation of the bed such that the temperature of the bed and accordingly of the entraining gases immediately downstream of the aforementioned location is substantially less than that immediately upstream of the aforementioned location.

A second example thereof, by way of exemplification and not limitation in this regard, is that which forms the subject matter of U.S. Pat. No. 2,983,259 entitled "Method and Aparatus of Steam Generation", which issued on May 9, 1961. In accordance with the teachings of U.S. Pat. No. 2,983,259, a lowermost heat exchange zone is provided. The material in this lowermost heat exchange zone is preferably made up at least in part of an active oxidation catalyst so as to give this zone a sufficiently high catalytic activity that a fuel-air mixture may be introduced directly thereinto and effectively and efficiently oxidized therein, liberating heat and accordingly producing a hot stream of gases that pass upwardly through the material with a portion of this heat being absorbed in this zone as well as the heat exchange zones located above this zone. In order to have efficient and complete combustion or oxidation within a fluidized bed of practical height and with the combustion supporting gas being preheated to a reasonable degree it is essential that an active oxidation catalyst be employed so that the material has sufficient catalytic activity to effect complete oxidation of the fuel and it is further essential when the heat content of the fuel is at all substantial that means be provided in contact with the material of this bed for absorbing substantial quantities of heat from the fluidized material in order that the temperature of the material will not rise above the deactivation temperature of the catalyst employed, i.e., the temperature above which the catalyst is permanently damaged so that it loses all or a vast majority of its catalytic activity.

A third example thereof, by way of exemplification and not limitation in this regard, is that which forms the subject matter of U.S. Pat. No. 2,997,031 entitled "Method of Heating and Generating Steam", which issued on Aug. 22, 1961. In accordance with the teachings of U.S. Pat. No. 2,997,031, a fuel-air mixture is passed over a body of catalytic oxidizing material, which may take the form of a very thin layer of particles, with this relatively small quantity of material having a very high catalytic activity with a low activation temperature and accordingly being a relatively expensive catalyst. The fuel-air mixture passing over this material is catalytically oxidized and the hot combustion gases thus produced are passed through the bed of material within which the conduit is immersed thereby raising the temperature of this material. The fuel and air is regulated so as to raise the temperature of this bed of material to the point where a fuel and air mixture introduced into the bed will be completely oxidized. Thereafter fuel and air are supplied to this bed and oxidized therewithin with little or no fuel then being passed over and in contact with the high activity catalyst.

A fourth example thereof, by way of exemplification and not limitation in this regard, is that which forms the subject matter of U.S. Pat. No. 3,101,697 entitled "Steam Generation", which issued on Aug. 27, 1963. In accordance with the teachings of U.S. Pat. No. 3,101,697, an oxidation catalyst is employed immediately upstream of a bed of material which is required to be heated to a much higher temperature than the oxidation catalyst before a fuel-air mixture will be oxidized or burned within the bed of material. A housing is provided within which is disposed a bed of discrete material. This bed of material is supported upon a plurality of horizontally disposed elongated members extending across the housing and disposed in generally parallel spaced relation such that the material cannot pass downward past these members but fluidizing gas may pass upwardly therethrough. These members are coated or impregnated with an active oxidation catalyst such that the activation temperature of the catalyst is substantially below the minimum bed temperature which is required to oxidize a fuel-air mixture. Means are provided to force air upwardly through the housing over the elongated members and through the bed of material to fluidize this material with an air heater being employed to heat the air sufficiently to raise the temperature of the catalyst to its activation temperature. Below the elongated members are a plurality of fuel distribution conduits and immediately above these members and in the lower portion of the bed there is another group of fuel distribution conduits. In operation, the fuel distribution conduits below the elongated members are first used to inject fuel into the housing and this fuel mixes with the air and is oxidized by the catalyst with the heat thus developed heating the bed of material or a portion of the bed to its required minimum temperature. Thereafter fuel is introduced into the fuel distribution conduits immediately above the elongated members and the supply of fuel below these members is terminated. In lieu of providing separate fuel distribution conduits below the elongated members, which support the bed, these members may be hollow with downwardly facing openings provided therein so that the members themselves form distribution conduits to which fuel may be supplied.

A fifth example thereof, by way of exemplification and not limitation in this regard, is that which forms the subject matter of U.S. Pat. No. 3,115,925 entitled "Method of Burning Fuel", which issued on Dec. 31,1963. In accordance with the teachings of U.S. Pat. No. 3,115,925, a start-up procedure is provided wherein the ignition temperature of the fluidized bed is greatly lowered. To this end, a catalyzing solution of a metal salt is sprayed or otherwise introduced onto the bed of particulate material, and thereafter the bed is preheated until ignition temperature has been reached. The dried residue of the salt remaining on the surface of the particles in the fluidized bed catalyze the ignition of the natural gas and the air at a much lower temperature than the 1150 degrees F., which would otherwise be the ignition point.

A sixth example thereof, by way of exemplification and not limitation in this regard, is that which forms the subject matter of U.S. Pat. No. 3,119,378 entitled "Steam Generation", which issued on Jan. 28, 1964. In accordance with the teachings of U.S. Pat. No. 3,119,378, a method of heating a fluid is provided comprising flowing upwardly a fluidized bed of discrete oxidation catalyst, which has an activation and a deactivation temperature, with the deactivation temperature being well below flame temperature, and a fuel-air mixture that is sufficiently rich in fuel so that it is outside the range of inflammability effecting catalytic oxidation of the fuel within the bed to the extent permitted by the air contained in the mixture while maintaining the temperature of the catalyst below the deactivating temperature, passing the remainder of the fuel and other effluent from the-bed upwardly through another fluidized bed of discrete inert material that is unaffected by flame combustion, thereby heating the material substantially to the temperature of the effluent and oxidizing sufficient fuel in the bed of catalyst to raise the temperature of the other bed to a sufficiently high value so as to oxidize a fuel-air mixture therein while maintaining the catalyst below its deactivation temperature, introducing sufficient air into this other bed to support combustion of this remaining portion of the fuel, effecting oxidation of the remaining fuel portion in this other bed, and imparting heat from the bed to a fluid by passing a fluid in indirect heat exchange relation with the beds.

A seventh example thereof, by way of exemplification and not limitation in this regard, is that which forms the subject matter of U.S. Pat. No. 4,325,32 entitled "Hybrid Fluidized Bed Combustor", which issued on Apr. 20, 1982. In accordance with the teachings of U.S. Pat. No. 4,325,327, a first atmospheric bubbling fluidized bed furnace is combined with a second, turbulent circulating fluidized bed furnace to produce heat efficiently from crushed solid fuel. The bed of the second furnace receives the smaller sizes of crushed solid fuel, unreacted limestone from the first bed, and elutriated solids extracted from the flue gases of the first bed. The two-stage combustor of crushed solid fuel is alleged to provide a system with an efficiency greater than that available through the use of a single furnace of a fluidized bed.

An eighth example thereof, by way of exemplification and not limitation in this regard, is that which forms the subject matter of U.S. Pat. No. 4,335,662 entitled "Solid Fuel Feed System For A Fluidized Bed", which issued on Jun. 22, 1982. In accordance with the teachings of U.S. Pat. No. 4,335,662, a fluidized bed for the combustion of coal, with limestone, is replenished with crushed coal from a system discharging the coal laterally from a station below the surface level of the bed. A compartment, or feed box, is mounted at one side of the bed and its interior is separated from the bed by a weir plate beneath which the coal flows laterally into the bed, while bed material is received into the compartment above the plate to maintain a predetermined minimum level of material in the compartment.

A ninth example thereof, by way of exemplification and not limitation in this regard, is that which forms the subject matter of U.S. Pat. No. 4,360,339 entitled "Fluidized Boiler", which issued on Nov. 23, 1982. In accordance with the teachings of U.S. Pat. No. 4,360,339, there is provided a fluidized bed cell having a static ignition bed of inert heat storage particles disposed immediately beneath and adjacent to a fluidizing region wherein fuel particles are combusted, characterized in that the heat storage particles are generally spherical in shape, each particle having a plurality of protuberances extending outwardly from the surface of the particle a preselected length thereby maintaining a minimum spacing equal to the preselected length of the protuberances, between neighboring spherical particles within the static ignition bed, thereby ensuring that sufficient void space exists within the static ignition bed for the fluidizing air to flow upward through the static ignition bed into the fluidizing region without an excessive pressure drop and for the fuel particles to laterally penetrate the static ignition bed.

A tenth example thereof, by way of exemplification and not limitation in this regard, is that which forms the subject matter of U.S. Pat. No. 4,445,844 entitled "Liquid Fuel And Air Feed Apparatus For Fluidized Bed Boiler", which issued on May 1, 1984. In accordance with the teachings of U.S. Pat. No. 4,445,844, a fluidized bed furnace is provided in which liquid fuel can be burned. Injectors extend up through an imperforate bed plate which properly mix the oil or other liquid fuel with the fluidizing air, causing evaporation of the oil. This mixture is passed through restricted openings as the mixture enters the fluidized bed, thus resulting in high velocity flow and fairly even fuel and combustion distribution throughout the cross-section of the fluidized bed.

An eleventh example thereof, by way of exemplification and not limitation in this regard, is that which forms the subject matter of U.S. Pat. No. 4.633,818 entitled "Mobile Coal-Fired Fluidized Bed Power Unit", which issued on Jan. 6, 1987. In accordance with the teachings of U.S. Pat. No. 4,633,818, a mobile coal-fired fluidized bed furnace system is provided for generating steam to power a locomotive. Coal is combusted within the fluidized bed furnace chamber in the fluidizing air to produce a hot flue gas, which passes from the furnace chamber through a boiler bank and an economizer. The steam generated in the boiler bank and the walls of the furnace chamber is collected in a steam drum and is passed therefrom through an in-bed superheater, and thence to the power generating means to produce the power, which drives the locomotive.

A twelfth example thereof, by way of exemplification and not limitation in this regard, is that which forms the subject matter of U.S. Pat. No. 5,401,130 entitled "Internal Circulation Fluidized Bed (ICFB) Combustion System And Method Of Operation Thereof", which issued on Mar. 28, 1995. In accordance with the teachings of U.S. Pat. No. 5,401,130, there is provided a fluidized bed combustion system particularly suited for use to effect the incineration, i.e., combustion, therewith of wood waste/sludge mixtures that have high moisture and ash content, which makes them difficult to burn. The fluidized bed combustion system includes a fluidized bed combustor embodying a fluidized bed composed of bed solids. Air is injected into the fluidized bed through an air distributor to establish a first controlled fluidizing velocity zone and a second controlled fluidizing velocity zone therewithin. Material is introduced into the fluidized bed combustor above the second controlled fluidizing velocity zone, whereupon the bed solids rain down upon the material, which is so introduced, and effect a covering thereof. The material is then dried, and thereafter combusted. Inerts/tramp materials/clinkers, as well as large diameter solids, entrained with the material are segregated therefrom, and then are removed from the fluidized bed combustor.

By way of exemplification and not limitation, the following are several other examples of prior art forms of fluidized bed units. The first of these is set forth in the paper entitled "An Introduction To The Solids Circulation Boiler" by J. G. Ballantyne, which was presented at the Coaltech '87 Conference that was held June 9–11, 1987 in London, England. In accordance with the mode of operation of the subject boiler as set forth in the aforereferenced paper, combustion takes place in a dense bubbling fluidized bed, arranged in 3 zones so that particle residence time is maximized. The bed is made up of sized, fused alumina beads plus fuel ash and limestone, and the main fluidizing velocity is selected such that only fine particles of ash and stone leave the bed with the flue gases. Because of the modest grit loadings and gas velocities, the flue gases can be passed through convective surface before being discharged to a multi-cyclone. This multi-cyclone, handling cooled gases, is of mild steel construction, and returns coarse particles of limestone and unburnt material to the bed for reuse. From the bed, a controlled quantity of material is continuously extracted by a non-mechanical valve, and cooled in a water-cooled channel integral with the boiler structure. The transport air required for carrying this material is used for secondary combustion purposes.

The originator of the boiler, which forms the subject matter of the above-entitled paper, is alleged to have been a W. B. Johnson. This is believed to be the same W. B. Johnson, who is the named inventor on U.S. Pat. No. 4,539,939 entitled "Fluidized Bed Combustion Apparatus And Method", which issued on Sep. 10, 1985. In accordance with the teachings of W. B. Johnson's U.S. Pat. No. 4,539,939, a plurality of relatively dense bead-like particles of inert solid material are maintained dispersed throughout the fluidized combustion bed for circulation through heat exchange means separated from the combustion bed, and are returned to the fluidized bed along with other bed constituents. Fine limestone particles may also be introduced into the combustion bed along with fresh fuel particles. The circulating bed constituents are discharged from an arched heat exchange outlet to direct the returning bed constituents in a generally horizontal direction directly over the combustion bed for generating increased circulation in the bed. In addition, the inlet for introduction of fresh fuel and fine limestone is located just below the arched discharge channel to enhance horizontal discharge velocity. A portion of the combustion chamber, generally opposite the arched discharge channel, is provided with a sloped wall segment to.further enhance circulation within the bed.

Before concluding with this discussion of prior art forms of fluidized bed units, it is believed that it is important that there be attention focused on several aspects of such prior art forms of fluidized bed units, particularly as regards the mode of operation and the nature of the construction of such prior art forms of fluidized bed units. To this end, it should be pointed out for instance that in accordance with the mode of operation and the nature of the construction of prior art forms of fluidized bed units and in particular, prior art forms of large circulating fluidized bed units, typically in such prior art forms of large circulating fluidized bed units the fine solid fuel ash/sorbent particles are separated from the flue gas before these fine solid fuel ash/sorbent particles are caused to flow to and through a fluid bed heat exchanger. As such, there is, therefore, no attempt made to classify the type of solid particles, which are caused to flow to and through the fluid bed heat exchanger. To this end, in accordance with such a mode of operation, the solid particles, which are caused to flow to and through the fluid bed heat exchanger, consist entirely of a mixture of all of the ash, which has been produced as a consequence of the combustion of the solid fuel in the presence of air within the combustor of such a prior art form of a large circulating fluidized bed unit.

In addition, attention, it is believed, should also be directed to the fact that in accordance with the mode of operation and the nature of the construction, in particular, of prior art forms of large circulating fluidized bed units, when fluid bed ash coolers are employed in such prior art forms of large circulating fluidized bed units such fluid bed ash coolers typically are used to cool the ash, which has been produced as a consequence of the combustion of the solid fuel in the presence of air within the combustor of such a prior art form of large circulating fluidized bed unit, as such ash is made to leave said prior art form of large circulating fluidized bed unit. Such a fluid bed ash cooler, it is recognized, may operate to effect a separation of large ash particles from the fines entrained therewith, before such separated fines are made to return to said large circulating fluidized bed unit. However, here again as was discussed previously in the preceding paragraph there is no attempt made in the case of the fluid bed ash cooler either to classify the type of solid particles, which collectively comprise the ash, which has been produced as a consequence of the combustion of the solid fuel in the presence of air in the combustor of said prior art form of large circulating fluidized bed unit. Namely, as was discussed in the preceding paragraph, the solid particles, which are separated by operation of such fluid bed ash coolers, consists entirely of a mixture of all of the ash that has been produced as a consequence of the combustion of the solid fuel in the presence of air in the combustor of said prior art form of large circulating fluidized bed units.

Further in this regard, attention is directed to the fact that in accordance with the teachings of U.S. Pat. No. 4,539,939 to which reference has previously been had herein, bed materials embodying bauxite are withdrawn from the bubbling bed. However, there is no disclosure to be found in said teachings of said U.S. Pat. No 4,539,939 of any attempt being made to separate any residual ash or fuel from the bed material embodying bauxite before such bed material embodying bauxite is caused to flow to the heat exchanger.

Therefore, by way of summary in this regard, it has thus been the customary practice insofar as prior art forms of fluidized bed units, and in particular, prior art forms of large circulating fluidized bed units are concerned, that no attempt is made in accordance with the mode of operation and the nature of the construction of such prior art forms of fluidized bed units to effect in the operation thereof a classification/separation between the various types of solid particles, before they are made to return to a fluid bed heat exchanger. Most importantly, it is respectfully submitted that no such attempt at classification/separation between the various types of solid particles is either disclosed or even suggested by the prior art in connection with a fluid bed heat exchanger and in particular where such a fluid bed heat exchanger comprises a counter flow heat transfer system. More specifically, it is respectfully submitted that there is no teaching or even suggestion to be found in any of the prior art documents to which reference has been had hereinbefore of effecting a classification/separation between the types of solid particles, which collectively comprise the ash that has been produced as a consequence of the combustion of the solid fuel in the presence of air in the combustor of prior art forms of fluidized bed units, either before or after such solid particles, are made to flow through a counter flow heat transfer system.

Although the fluidized-bed boilers constructed in accordance with the teachings of the various U.S. patents to which reference has been had hereinbefore, as well as the fluidized-bed boiler that forms the subject matter of the aforereferenced paper that was presented at the Coaltech '87 Conference have been alleged to have been demonstrated to be operative for the purpose for which they have been designed, there has been evidenced in the prior art a need for such fluidized-bed boilers to be further improved. More specifically, there has been evidenced in the prior art a need for a low cost heat transfer system embodying a design, which is predicated on a novel approach, and which is characterized by its solids enhanced heat transfer. To this end, a fundamental characteristic, which is not surprising in view of the term employed to refer thereto, i.e., "fluidized-bed boiler", of all such fluidized-bed boilers constructed in accordance with the teachings of the various U.S. patents to which reference has been hereinbefore, as well as the fluidizing-bed boiler that forms the subject matter of the aforereferenced paper that was presented at the Coaltech '87 Conference, is the need for the utilization therein of fluidizing air in order to effect the operation of the fluidized-bed boiler, regardless of whether the fluidized-bed boiler is designed to employ a bubbling bed type mode of operation or a circulating fluidized bed type mode of operation. Namely, regardless of whether a bubbling type mode of operation is employed or whether a circulating fluidized bed type mode of operation is employed, there still nevertheless exists a requirement that fluidizing air be utilized for some purpose if the desired mode of operation is to be accomplished effectively. Such fluidizing air, irrespective of whether a bubbling bed type mode of operation is being employed or whether a circulating fluidized bed type mode of operation is being employed, is designed to be injected at a preselected velocity, the selection of which is determined principally by the fact of whether the particular fluidized-bed boiler is intended to be operated in a bubbling bed type mode or in a circulating fluidized bed type mode, whereby such fluidizing air is caused to flow through a bed comprised of particles of materials, the nature of which may take many forms, e.g., fuel particles, limestone particles, inert particles, etc. As such, because of the need heretofore for the use of such fluidizing air in prior art forms of fluidized-bed boilers, it was thus not possible heretodate to effect a complete decoupling of the combustion, heat transfer and environmental control processes therewith, and as a consequence of this fact, with such prior art forms of fluidized-bed boilers heretofore, there has not existed the possibility of allowing each of these processes, i.e., the combustion process, the heat transfer process and the environmental control process, to be separately optimized.

It is, therefore, an object of the present invention to provide a new and improved design for a heat transfer system that is predicated upon the employment therefor of a new and novel approach insofar as heat transfer systems are concerned.

It is another object of the present invention to provide such a new and improved heat transfer system that is characterized by its low cost.

It is still another object of the present invention to provide such a new and improved heat transfer system that is characterized by the fact that solids enhanced heat transfer is capable of being realized therewith.

It is yet another object of the present invention to provide such a new and improved heat transfer system that is characterized by the fact that therewith there is a complete decoupling of the combustion, heat transfer and environmental control processes.

Another object of the present invention is to provide such a new and improved heat transfer system that is characterized by the fact that by virtue of the complete decoupling therewith of the combustion, heat transfer and environmental control processes, it thus enables each of these processes to be separately optimized.

Still another object of the present invention is to provide such a new and improved heat transfer system that is characterized by the fact that the heat transfer solids, e.g., bauxite, are effectively separated from the solid fuel ash, sorbent, combustibles, and flue gas in a classification step before these heat transfer solids are caused to flow to a heat transfer means.

A still another object of the present invention is to provide such a new and improved heat transfer system that is characterized by the fact that such a heat transfer system is not affected by changing fuel properties, be the fuel a solid, a liquid or a gas by virtue of the existence of the classification process employed therewith whereby only the heat transfer solids, e.g., bauxite, are in contact with the heat transfer means.

A yet another object of the present invention is to provide such a new and improved heat transfer system that is characterized by the fact that to the extent that an internal heat source is employed in connection with such a new and improved heat transfer system there is thus no heat transfer surface embodied in the area of the internal heat source.

A further object of the present invention is to provide such a new and improved heat transfer system that is characterized by the fact that such a heat transfer system nevertheless still retains the capability to effect therewith a minimization of NOx emissions.

Yet an object of the present invention is to provide such a new and improved heat transfer system that is characterized by the fact that therewith sulfur capture is decoupled from the combustion process.

Yet a further object of the present invention is to provide such a new and improved heat transfer system that is characterized by the fact that in accordance with the best mode embodiment thereof the need for a fluidized bed heat exchanger is eliminated therewith with the concomitant benefits being derived as a consequence thereof that auxiliary power is reduced and the cost of blowers and ductwork associated therewith is avoided, although it is still possible with such a new and improved heat transfer system to have a fluidized bed design wherein external heat transfer surface is followed by a counter current section at one end thereof.

Yet another object of the present invention is to provide such a new and improved heat transfer system that is characterized by the fact that it is possible therewith to employ a cold cyclone in lieu of a hot cyclone, the latter being what is customarily more generally required to be utilized.

Yet still another object of the present invention is to provide such a new and improved heat transfer system that is advantageously characterized in that such a heat transfer system is relatively inexpensive to provide, while also being relatively simple in construction.

SUMMARY OF THE PRESENT INVENTION

In accordance with the present invention there is provided a new and improved heat transfer system, the design of which is predicated upon the employment therefor of a new and novel approach insofar as heat transfer systems are concerned. More specifically, the subject heat transfer system of the present invention represents a new and novel approach to designing a low cost heat transfer system using solids enhanced heat transfer. The concept, which the subject heat transfer system of the present invention embodies, involves a complete decoupling of the combustion, heat transfer and environmental control processes, thus allowing each to be separately optimized. Based on a cost comparison between the heat transfer system of the present invention and a 100 MW circulating fluidized bed system of conventional construction, it has been determined from the results of such a cost comparison that the costs of all pressure parts for the heat transfer system of the present invention could be reduced approximately 65% from that of the 100 MW circulating fluidized bed system of conventional construction, and that significant reductions in structural steel, plant footprint, and building volume are also achievable with the heat transfer system of the present invention versus that attainable with the 100 MW circulating fluidized bed system of conventional construction.

Continuing, the subject heat transfer system of the present invention employs a hybrid design capable of operating at high temperatures, e.g., up to 1100 degrees C., and with low solids recirculation rates from the cyclone. A second solids circulation loop is also superimposed thereupon. In accord with the mode of operation of the heat transfer system of the present invention, a dense stream of cold solids is introduced into the top of a first portion thereof. These solids are then heated as a result of a recuperative heat transfer, which occurs within this first portion of the heat transfer system of the present invention, between these cold solids and a heat source, which in turn may be generated either within this first portion of the heat transfer system of the present invention or externally thereof, as these solids drop towards the bottom of this first portion of the heat transfer system of the present invention, while the heat source itself in turn is being cooled down so as to be at a low temperature at the outlet of this first portion of the heat transfer system of the present invention. The hot bed solids are drained from this first portion of the heat transfer system of the present invention into a plenum heat exchanger which although not required in accordance with the best mode embodiment of the invention is located below this first portion of the heat transfer system of the present invention. In this regard, the plenum heat exchanger need not be located directly under the combustor so long as the plenum heat exchanger is located near enough to the combustor such that the heat transfer solids can flow downward by gravity from the combustor into the plenum heat exchanger. All of the heat transfer surface of the heat transfer system of the present invention, in accord with the best mode embodiment of the invention, is located in this plenum heat exchanger. In accord with the mode of operation of the heat transfer system of the present invention, the solids slowly move downward through this plenum heat exchanger in a manner, which in accord with the best mode embodiment of the present invention is similar in nature to that of a moving bed. The direct contact of the hot solids with the tubes, which are suitably located for this purpose within the plenum heat exchanger, provides a high rate of conductive heat transfer therebetween and reduces the total amount of heat transfer surface requirements.

Some of the key features that serve to advantageously characterize the heat transfer system of the present invention vis-a-vis prior art forms of heat transfer systems are the following: a) significantly reduced heat transfer surface, b) high temperature Rankine cycles are possible with the technology that the heat transfer system of the present invention embodies, c) simple pressure part design, d) standard pressure part design, e) simple support design, f) reduced gas side pressure drop, and g) process optimization. Significantly reduced heat transfer surface is achieved by virtue of the fact that in accordance with the design, which the heat transfer system of the present invention embodies, all pressure part heat transfer surface is consolidated into a single counterflow heat exchanger, which is located relative to the aforereferenced first portion of the heat transfer system of the present invention such that it is possible for the heat transfer solids to flow downwardly by gravity from the combustor to said heat exchanger. As such, the direct contact between the hot solids and the heat transfer surface provides high heat transfer rates for all surfaces. In addition, extended surfaces can be utilized in the heat transfer system of the present invention, which further reduces the requirements for heat transfer surface. A cost comparison study has shown that the total pressure part weight and cost for the heat transfer system of the present invention would be about one-third that of a circulating fluidized bed system operating at the same design conditions as the heat transfer system of the present invention.

The heat transfer system of the present invention enables high temperature Rankine cycles and their high plant efficiencies to be utilized without the need for developing or using exotic materials. Furthermore, the high heat transfer rates obtained through the use in the heat transfer system of the present invention of the moving bed-like movement of the hot solids moving bed, in accord with the best mode embodiment of the present invention, eliminates the need for very high temperature differentials between such hot solids and the tubes of the plenum heat exchanger and concomitantly reduces maximum tube metal temperatures. High temperature steam conditions can thus be realized with moderate temperatures within the aforereferenced first portion of the heat transfer system of the present invention thereby enabling the use of readily available high nickel alloys. Tests have shown that adding extended surface to the tubes of the plenum heat exchanger of the heat transfer system of the present invention has a dramatic impact on the heat transfer surface requirements. In this regard, the high heat transfer rates and extended tube surfaces, which are attainable with the heat transfer system of the present invention, greatly reduce the cost of all heat transfer sections, with about a 50% reduction being achievable in the expensive high temperature sections. If so desired, additional surface reductions are possible with the development of high temperature finned surfaces.

The heat transfer system of the present invention functions as a once through heat transfer system with a single circuit for economizer, evaporator and superheater. The single section superheater thereby eliminates the need for intermediate headers. Furthermore, where applicable, the heat transfer system-turbine connecting piping is greatly reduced because the steam outlets from the heat transfer system of the present invention are located at the same elevation as the turbine. With the heat transfer system of the present invention steam-side and gas-side imbalances can be minimized as a consequence of controlling solids flow over the different tube sections thereof. Moreover, there is no requirement for sootblowers, since the heat transfer sections do not come in contact with the fuel ash. Additionally, the conductive heat transfer, which is produced as a consequence of the moving bed-like movement, in accordance with the best mode embodiment of the present invention, provides a uniform heat flux around the tube centerline, unlike the waterwalls, which are commonly employed in prior art heat transfer systems, that are subjected to one-sided heating. What's more, since the heat transfer system of the present invention lacks waterwalls, waterwall limitations due to a mix of austenitic/ferritic materials or stress differentials due to single sided heat fluxes, which serve to disadvantageously characterize prior art heat transfer systems, are eliminated. In addition, high temperature corrosion to which prior art heat transfer systems are known to be subjected, is also eliminated with the heat transfer system of the present invention.

As is well known to those skilled in the art, the pressure part arrangement for a circulating fluidized bed system of conventional construction must be designed for the specific fuels fired in the combustor thereof. It is also well known to those skilled in the art that the gas flow rate through the backpass of a circulating fluidized bed system of conventional construction increases with higher fuel moisture. Therefore, the tube spacing in the backpass of a circulating fluidized bed system of conventional construction must be increased for high moisture fuels to maintain proper gas velocities through such tubes, thus resulting in larger and more expensive backpasses in the case of circulating fluidized bed systems of conventional construction. Accordingly, insofar as circulating fluidized bed systems of conventional construction are concerned, the combustor thereof must be designed to accommodate the worst fuel when multiple fuels are required.

On the other hand, the heat transfer surface in the heat transfer system of the present invention is not affected by changing fuel properties, either when an internally generated heat source is employed in connection with the heat transfer system of the present invention or when an externally generated heat source is employed in connection therewith. This stems from the fact that in neither case do the combustion gases and fuel ash contact the heat transfer surface of the heat transfer system of the present invention. This is because of the inclusion of a classification process to which reference will be had hereinafter, which in accordance with the best mode embodiment of the present invention is located before the plenum heat exchanger, such that this classification process is operative to separate the heat transfer solids, e.g., bauxite, from the solid fuel ash, sorbent, combustibles and flue gas. In addition, the heat transfer system of the present invention will have higher gas velocities through the first portion thereof with high moisture fuels, when an internally generated heat source is employed in connection with the heat transfer system of the present invention. Finally, when an internally generated heat source is employed in connection with the heat transfer of the present invention, heat recuperation in the first portion of the heat transfer system of the present invention can be maintained for different fuels through changes in recirculating particle size and recirculation rate.

Continuing, the first portion of the heat transfer system of the present invention does not embody any heat transfer surface therewithin, and is thus ideal for a cylindrical, self-supporting design with a thin refractory shell. Moreover, such an arrangement, insofar as the heat transfer system of the present invention is concerned, eliminates the need for buckstays and greatly reduces structural steel requirements. In addition, since the heat source is cooled within the first portion of the heat transfer system of the present invention, the cold cyclone will be significantly smaller than that employed in circulating fluidized bed-systems of conventional construction and concomitantly will require only small amounts of refractory and structural steel. Also, with the heat transfer system of the present invention, the support requirements for the heat exchangers thereof are substantially reduced because the tube bundles employed in such heat exchangers are located close to the ground and are much lighter than those that are employed in a circulating fluidized bed system of conventional construction.

It is also to be noted that the solids circulation rate in the heat transfer system of the present invention is much less than that in a circulating fluidized bed system of conventional construction, and thus has a lower gas side pressure drop. Also, the heat exchanger through which the hot solids move in a moving bed-like fashion, in accordance with the best mode embodiment of the present invention, which is employed in the heat transfer system of the present invention, eliminates the need, in accordance with the best mode embodiment of the present invention, for a fluidized bed heat exchanger (FBHE), the latter being a component that is commonly employed in a circulating fluidized bed of conventional construction, which in turn reduces auxiliary power requirements and the cost of blowers and ductwork.

From the foregoing, it should be readily apparent that the heat transfer system of the present invention provides some unique opportunities for process optimization because with the heat transfer system of the present invention, the combustion, heat transfer, and environmental control processes are effectively decoupled. Yet, with the heat transfer system of the present invention conventional fluidized bed system fuel flexibility is still capable of being maintained within the high temperature first portion thereof, coupled with cyclone recycle for carbon burnout. In addition, the following features are also attainable with the heat transfer system of the present invention: NOx emissions can be minimized in the lower part of the first portion of the heat transfer system of the present invention; sulfur capture is decoupled from the heat source generating process of the heat transfer system of the present invention by utilizing a suitable backend system for this purpose; and limestone may still be calcined in the first portion of the heat transfer system of the present invention although a requirement thereof, in accordance with the best mode embodiment of the present invention, is that such limestone be fine enough to pass through the first portion of the heat transfer system of the present invention in a single pass. However, it is recognized that there may be situations such as for very high sulfur coals wherein it may be desirable to try and obtain some sulfur capture in the first portion of the heat transfer system. In such a situation, it might be desirable to size the limestone such that the limestone will be subjected to recirculation a few times before passing through a cyclone.

DESCRIPTION OF THE PREFERRED EMBODIMENT

Figure 1:
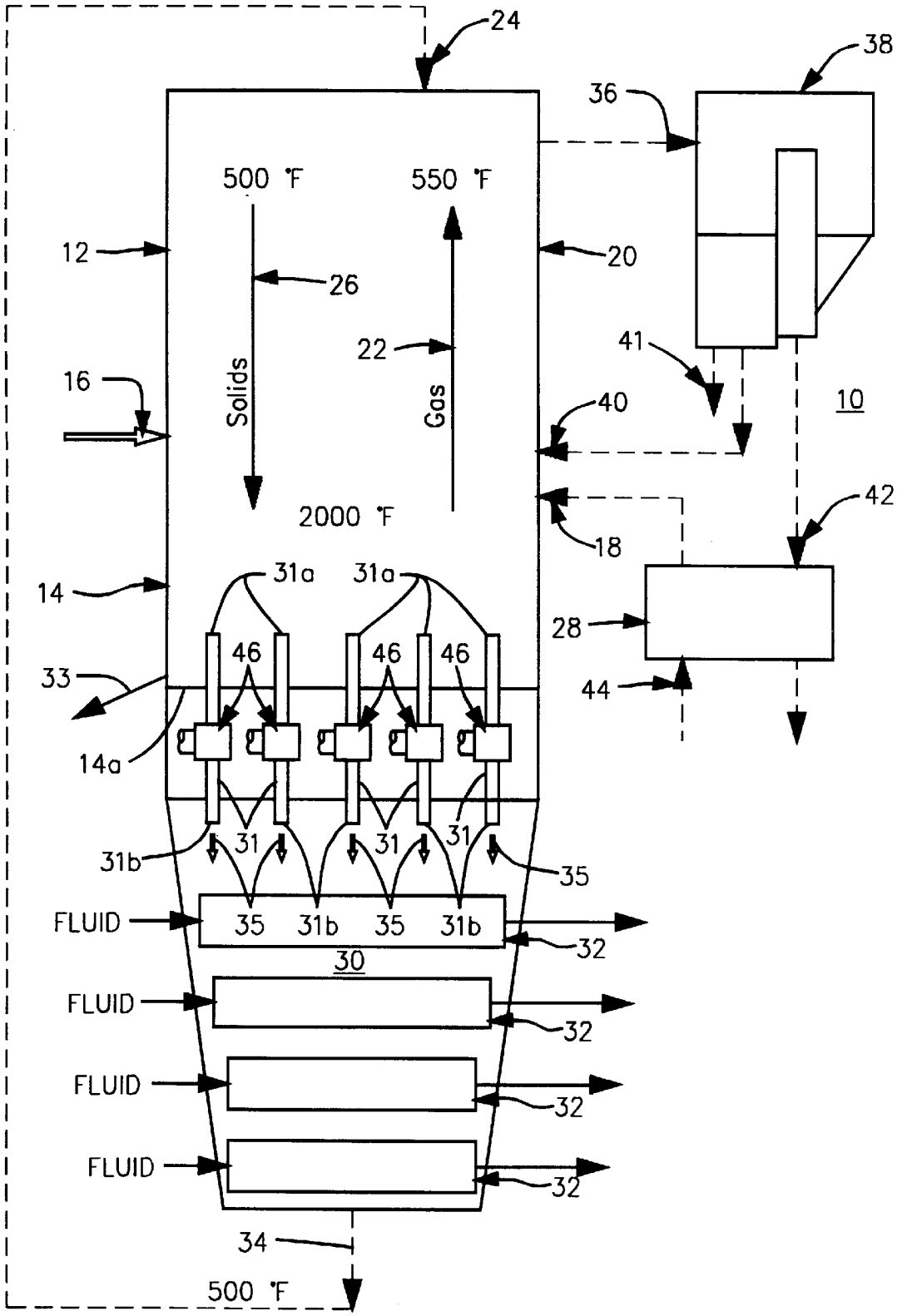
FIG. 1 is a diagrammatic illustration of a heat transfer system constructed in accordance with the present invention, depicted with an internally generated heat source being employed in connection therewith.

Referring now to the drawings, and more specifically to FIG. 1, there is depicted therein a heat transfer system, generally designated by the reference numeral 10, constructed in accordance with the present invention, which is depicted therein with an internally generated heat source being employed in connection therewith. As best understood with reference to FIG. 1, the heat transfer system 10 includes a first portion, i.e., a vessel, which is generally designated by the reference numeral 12, and which is itself composed of two zones, i.e., a lower zone and an upper zone. The lower zone, generally designated by the reference numeral 14, is operative as a combustion zone, i.e., as the zone in which the internally generated heat source is generated. It is within this zone 14 that fuel is injected thereinto, as depicted by the arrowhead denoted by the reference numeral 16, and the combustion air that is injected thereinto, as depicted by the reference numeral 18, are combusted, preferably through the use of conventional bubbling bed technology, thereby producing an internally generated heat source in the form of hot gases, which are produced, i.e., generated, as a consequence of such combustion of the fuel 16 and the combustion air 18.

The upper zone, generally designated by the reference numeral 20, of the vessel 12, i.e., the zone within the vessel 12 that is located above the zone 14, is operative in the manner of a reactor such that a relatively large residence time, on the order of 6 to 7 seconds, is provided whereby a recuperation, to which further reference will be had hereinafter, can occur wherein heat from the internally generated heat source, i.e., the gases, which constitute the products of combustion produced within the zone 14, that undergo an upward flow, as depicted by the arrow denoted by the reference numeral 22, is transferred to a flow of solid particles that are injected, as depicted by the arrowhead denoted by the reference numeral 24, into the upper zone 20 of the vessel 12, and which undergo a downward flow, as depicted by the arrow denoted by the reference numeral 26. As such, the upper zone 20 of the vessel 12 essentially functions in the manner of a counter flow, direct contact heat exchanger. To this end, no transfer of heat to water/steam takes place in either the zone 14 of the vessel 12 or in the upper zone of the vessel 12. Accordingly, the walls of the vessel 12 are designed so as to permit them to be refractory lined. Moreover, the solid particles 24 are effective in recuperating the heat from the internally generated heat source, i.e., the gases 22, down to a temperature, which is sufficiently low as to enable the use in the heat transfer system 10 of the present invention of a conventional form of air heater, the latter being schematically depicted in FIG. 1, wherein the said air heater is generally designated by the reference numeral 28.

In accordance with the preferred embodiment of the invention, the solid particles 24 that are employed for purposes of effecting therewith the recuperation of the heat from the gases 22 are designed so as to have a high density as well as a high thermal conductivity. Namely, the higher the density thereof and the greater the number of solid particles 24, i.e., the higher the surface area of the solid particles 24, the smaller the vessel 12 can be. To this end, it has been found that a variety of the forms of bauxite, e.g., Al2O3, are suitable for use as the solid particles 24. In this regard, not only is this variety of the forms of bauxite, e.g., Al2O3, attractive because of their thermal properties, but in addition because they serve as a raw material for low tech ceramics, they are available in virtually every country of the world. However, it is to be understood that there are other types of particles, embodying the characteristics mentioned above, which such particles should desirably embody, that may also be employed in lieu of the variety of the forms of bauxite mentioned hereinbefore, without departing from the essence of the present invention.

The solid particles 24 that are employed for purposes of effecting therewith the recuperation of the heat from the gases 22 are also designed to have a much higher density and particle size than the solid fuel ash and sorbent particles. The solid particles 24 are designed to fall downwards through the furnace at the maximum gas velocities within the upper zone 20 of the vessel 12, that is, the terminal velocity of the solid particles 24 within the upper zone 20 of the vessel 12 is greater than the maximum gas velocity within the upper zone 20 of the vessel 12. The cross-sectional area within the upper zone 20 of the vessel 12 is designed to ensure that the gas velocities therewithin are high enough to entrain most of the solid fuel ash and sorbent particles and carry them upwards and out of the vessel 12 as denoted by the arrow designated by the reference numeral 36 in FIG. 1 in a manner to which further reference will be had hereinafter.

The solid particles 24 are drained from the lower zone 14 of the vessel 12 in such a manner as to ensure that essentially no fines or coarse solid fuel ash or sorbent is also transferred to the plenum heat exchanger, which is denoted by the reference numeral 30. In accordance with the best mode embodiment of the present invention, a plurality of bed drain pipes, each of which is denoted in FIG. 1 by the same reference numeral 31 and to which further reference will be had hereinafter, is located such that the inlet of each one of the plurality of bed drain pipes 31, each such inlet being denoted in FIG. 1 by the same reference numeral 31*a*, is located above the floor, denoted by the reference numeral 14*a*, of zone 14 of the vessel 12. Through the use of this design, involving the employment of a plurality of bed drain pipes 31 each having an inlet 31*a* thereof located above the floor 14*a* of zone 14 of vessel 12, no large rocks, etc. are allowed to pass from the zone 14 of the vessel 12 to the plenum heat exchanger 30. Therefore, such large rocks, etc. are only removable from the vessel 12 by means of a separate bed drain disposal system, the latter being schematically indicated in FIG. 1 by the arrow that is denoted by the reference numeral 33 in FIG. 1.

Figure 4:
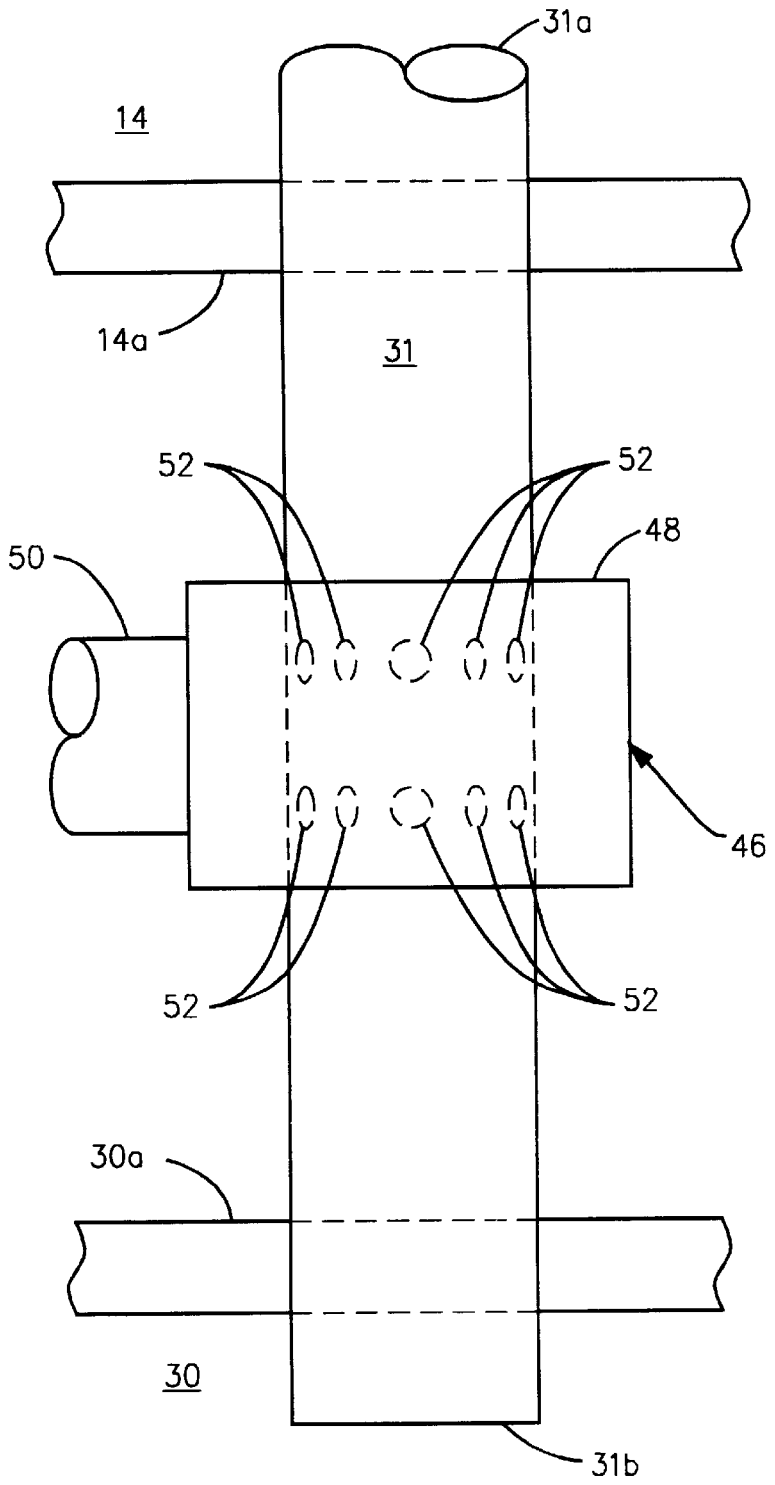
FIG. 4 is a side elevational view on an enlarged scale of the section of the heat transfer system of the present invention whereat the classification process is performed whereby the heat transfer solids, e.g., bauxite, are separated from solid fuel ash, sorbent, combustibles and flue gas.

In a manner to be more fully described herein in connection with the discussion of FIG. 4 in particular of the drawings, air is introduced into each of the plurality of bed drain pipes 31 in a sufficient amount whereby the velocity thereof is high enough to prevent the flow of fines, solid fuel ash and sorbent particles down any one or more of the plurality of bed drain pipes 31, while at the same time the velocity of this air flow is not sufficient enough to impede the downward flow of the solid particles 24 through each one of the plurality of bed drain pipes 31 to the plenum heat exchanger 30. The air that is introduced into each of the plurality of bed drain pipes 31 is also operative to effect therewith the combustion of any unburned carbonaceous matter that might enter any one or more of the plurality of bed drain pipes 31. The heat produced from such combustion is designed to be returned from the respective ones of the plurality of bed drain pipes 31 to the vessel 12.

Continuing with the description of the heat transfer system 10 of the present invention as depicted in FIG. 1, the heat transfer system 10 constructed in accordance with the present invention further includes a second portion, i.e., the plenum heat exchanger 30 to which reference has been had herein previously. Suitably supported within the plenum heat exchanger 30 in mounted relation therewithin, as will be best understood with reference to FIG. 1, are one or more heat transfer surfaces. In accordance with the illustration in FIG. 1 of the heat transfer system 10 of the present invention, four such heat transfer surfaces, each denoted by the same reference numeral 32 in FIG. 1, are schematically depicted in suitably supported mounted relation within the plenum heat exchanger 30 through the use of any conventional form of mounting means (not shown in the interest of maintaining clarity of illustration in the drawings) suitable for use for such a purpose, such as preferably to be suitably spaced from each other within the plenum heat exchanger 30. It is to be understood, however, that a greater or lesser number of such heat transfer surfaces 32 could be employed in the plenum heat exchanger 30 without departing from the essence of the present invention.

Through the plenum heat exchanger 30 there is essentially a simple mass flow of the solid particles 24 that have entered the plenum heat exchanger 30 after flowing through and having been discharged as schematically depicted by the arrowheads, each being denoted by the same reference numeral 35, from the outlet, designated by the reference numeral 31*b*, of each of the plurality of bed drain pipes 31, such that once these solid particles 24 have recuperated within the first portion 20 of the vessel 12 the heat from the internally generated heat source, i.e., from the gases 22, these solid particles 24 move downwardly, primarily under the influence of gravity, at a very low velocity, e.g., on the order of 40 m./hr. As such, these solid particles 24 as they move downwardly take on the characteristics of a moving bed. Although in accordance with the best mode embodiment of the present invention, these solid particles 24 as they move downwardly take on the characteristics of a moving bed, it is to be understood that these solid particles 24 could also move downwardly in some other manner without departing from the essence of the present invention. The important point here is that the heat transfer function preferably be performed completely in a counter flow fashion or alternatively that the heat transfer function be performed, at a minimum, at least partially in a counter flow fashion. To this end, at least part of the heat exchange function must be performed in a counter flow fashion.

In the course of moving downward in the manner to which reference has been had hereinabove, this downward moving mass flow of solid particles 24 flows over the heat transfer surfaces 32, which in accord with the best mode embodiment of the present invention preferably each consists of a plurality of individual tubes (not shown in the interest of maintaining clarity of illustration in the drawings), which when taken collectively comprise a single one of the heat transfer surfaces 32. Through each of these tubes (not shown) of each of the heat transfer surfaces 32, there flows, as depicted schematically by the arrows that are each labeled with the word "FLUID", the "working fluid" of a cycle. As it is being used here, the term "working fluid" is intended to refer to the "working fluid" of a thermodynamic cycle such as, for example, steam or ammonia, as well as to a process feedstock. The conductive heat exchange that is effected between the downward moving mass flow of solid particles 24 and the working fluid that flows through the tubes (not shown), which when taken collectively comprise one of the heat exchanger surfaces 32, is preferably as has been discussed hereinabove one hundred percent counter flow. Although as has also been discussed hereinabove such conductive heat exchange between the downward moving mass flow of solid particles 24 and the working fluid that flows through the tubes (not shown) may alternatively, at a minimum, be at least partially counter flow.

There exists no necessity therewith to change the spacing between the individual tubes (not shown) that collectively comprise each of the heat transfer surfaces 32, when the fuel employed, which is subjected to combustion, for purposes of generating therefrom the internally generated heat source, changes. Further, since there is no flow of gases over the individual tubes (not shown) that collectively comprise each of the heat transfer surfaces 32, there is accordingly no gas side velocity constraints that in gas-to-tube heat exchangers creates the need for multiple sections of superheater, reheater, evaporator and economizer heat transfer surfaces, which most commonly are required in the case of prior art forms of circulating fluidized bed systems as well as in prior art forms of pulverized coal fired steam generators. As such, it is considered to be possible with the heat transfer system 10 of the present invention to provide a single circuit from the economizer inlet thereof to the superheater outlet thereof with the concomitant effect therefrom that header pressure losses are largely eliminated.

In accord with the best mode embodiment of the present invention the solid particles 24 in the plenum heat exchanger 30 consist of virtually one hundred percent bauxite, i.e., Al2O3, and include only a minimum amount of solid fuel ash. This is by virtue of the fact that a classification is effected within the vessel between the solid particles 24 of bauxite, i.e., Al2O3, and the solid fuel ash. Namely, the solid fuel ash from the combustion of the solid fuel 16 and the combustion air 18 within the zone 14 of the vessel 12 are of micron size and of low density and thus become entrained in the upward flow of the gases 22. On the other hand, the solid particles 24 of bauxite, i.e., Al2O3, are very dense and 600 to 1200 microns in size and as such are too large to become entrained in the upward flow of the gases 22. In addition, the design of the plurality of bed drain pipes 31 coupled with the introduction of air thereinto as has been mentioned hereinabove and to which further reference will be had hereinafter in connection with the discussion of FIG. 4 of the drawings provides additional classification and further ensures that only the solid particles 24 of bauxite, i.e., Al2O3, are passed downward to the plenum heat exchanger 30. Thus, primarily under the influence of gravity the solid particles 24 of bauxite, i.e., Al2O3, move downwardly as has been described hereinabove previously.

With continuing reference to FIG. 1 of the drawings, when the solid particles 24 reach the bottom of the plenum heat exchanger 30, as viewed with reference to FIG. 1, the solid particles 24 are cool enough, i.e., are at a temperature of approximately 500 degrees F. such that the solid particles 24, as indicated schematically by the dotted line generally designated by the reference numeral 34 in FIG. 1 can be transported back to the top of the vessel 12 for injection into the first portion 20 thereof, as has been described hereinabove previously in order to once again repeat the process of the solid particles 24 flowing through.the vessel 12 and thereafter through the plenum heat exchanger 30. This flow of the solid particles 24 within the heat transfer system 10 of the present invention will be referred to herein as the "lower recycle loop".

With further reference to the matter of the solid fuel ash that is produced from the combustion of the solid fuel 16 and the combustion air 18 within the zone 14 of the vessel 12 of the heat transfer system 10 of the present invention, as depicted in FIG. 1 of the drawings, wherein an internally generated heat source is employed in connection therewith, this solid fuel ash, as has been described hereinabove previously, becomes entrained with the gases 22 and thus flows upwardly therewith from the zone 14 of the vessel 12 into and through the first portion 20 of the vessel 12, and ultimately the gases 22 with the solid fuel ash entrained therewith are discharged, as depicted by the arrow denoted by the reference numeral 36 in FIG. 1, to a low temperature, i.e., cold, cyclone of conventional construction, the latter cold cyclone being generally designated by the reference numeral 38 in FIG. 1. Within the cold cyclone 38, in a manner well-known to those skilled in the art, the solid fuel ash is separated from the gases 22. After the separation thereof within the cold cyclone 38, a portion of the separated solid fuel ash, as depicted by the arrow and dotted line generally designated by the reference numeral 40 in FIG. 1, is made to return to the zone 14 of the vessel 12 and with the remainder of the separated solid fuel ash being discharged, as depicted by the arrow and dotted line generally designated by the reference numeral 41 in FIG. 1, from the cold cyclone 38 for the eventual disposal thereof. On the other hand, the gases 22 after having the solid fuel ash separated therefrom in the cold cyclone 38 are discharged from the cold cyclone 38 to the air heater 28, as depicted by the arrow and dotted line generally designated by the reference numeral 42 in FIG. 1. The solid fuel ash recycle as described above and which will be referred to herein as the "upper recycle loop"primarily performs the following two functions: 1) it reduces the amount of unburned carbon that would otherwise be discharged from the vessel 12, and 2) it enables additional control to be had therewith over the temperature that exists within the plenum heat exchanger 30.

The temperature of the plenum heat exchanger 30 is very important because it forms the basis for the conductive heat transfer between the downward moving mass of solid particles 24 and the tubes (not shown) of the heat transfer surfaces 32 and thereby the working fluid that is flowing through these tubes (not shown). In the heat transfer system 10 of the present invention, the temperature within the plenum heat exchanger 30 is a function of the Q fired, the excess air, the upper recycle rate, and the lower recycle rate. For a given Q fired, the independent variables become the upper recycle rate and the lower recycle rate. If it were to become necessary to increase the temperature of the solid particles 24, the lower recycle rate could be reduced, but the exit temperature of the gases 22 from the first portion 20 of the vessel 12 would increase due to the reduced surface area in which to recuperate the heat from the heat source, i.e., when an internally generated heat source is being employed in connection with the heat transfer system 10 of the present invention this heat source is the gases 22 produced from the combustion of the solid fuel 16 and combustion air 18 within the zone 14 of the vessel 12. The upper recycle rate could be reduced to increase the temperature of the solid particles 24, but carbon loss would increase due to the fact that unburned carbon in the solid fuel ash would have fewer opportunities to be recycled from the cold cyclone 38 to the zone 14 of the vessel 12. Thus, the best strategy is considered to probably be some combination involving an adjustment of each of the two variables, i.e., some adjustment in the lower recycle rate as well as some adjustment in the upper recycle rate. Note is also taken herein of the fact that the upper limit of the temperature within the plenum heat exchanger 30 is driven by the ash fusion temperature of the solid fuel 16, which is nominally 1100 degrees C. To this end, for the solid particles 24 to remain free flowing within the plenum heat exchanger 30 the temperature within the plenum heat exchanger 30 must remain below the temperature where the solid fuel 16 and the combustion air 18 within the zone 14 of the vessel 12 is sticky.

Figure 2:
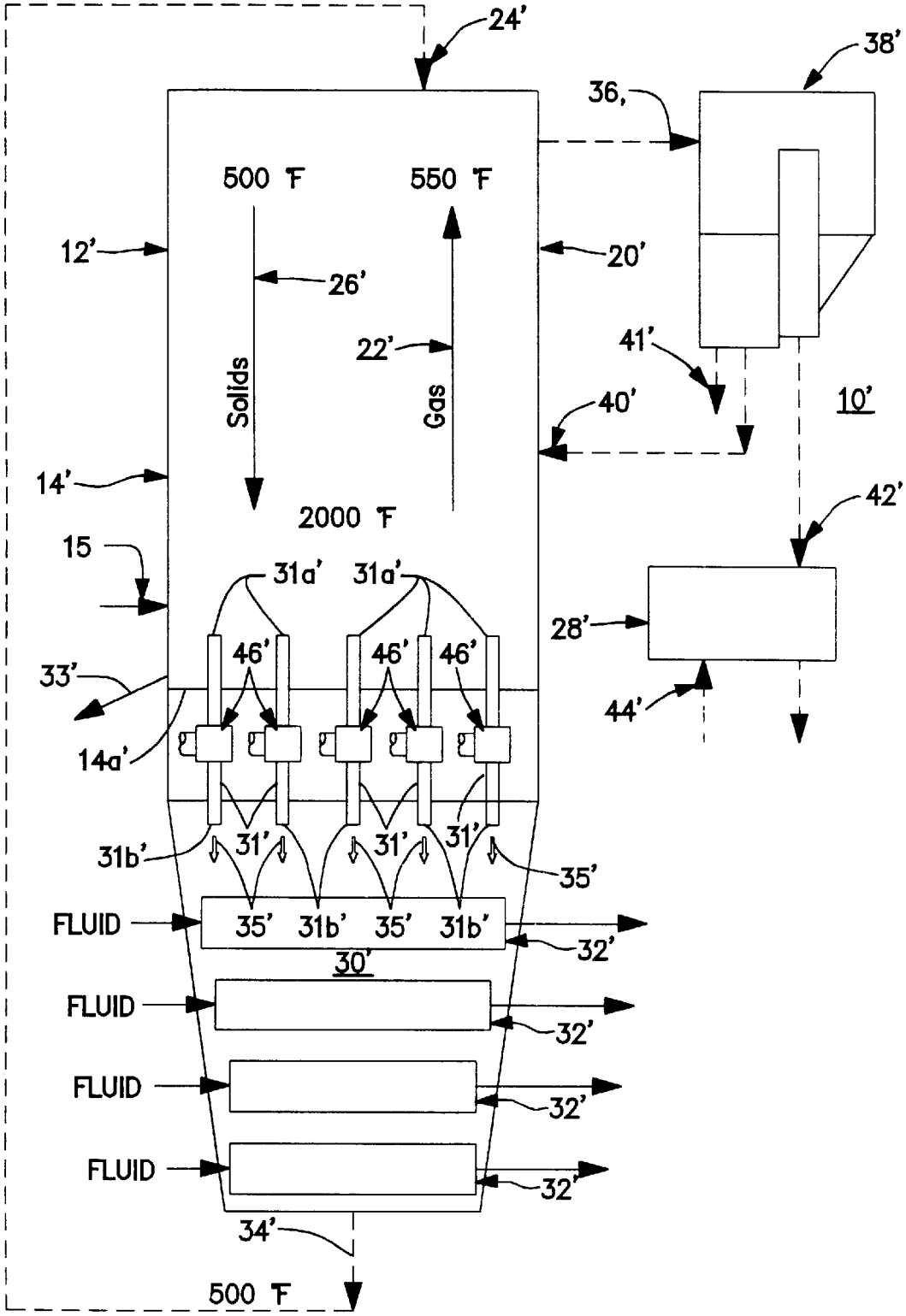
FIG. 2 is a diagrammatic illustration of a heat transfer system constructed in accordance with the present invention, depicted with an externally generated heat source being employed in connection therewith.

Collecting in the mass of free flowing solid particles 24 or the solid particles 24' through recuperation the heat from the heat source, when such heat source is an internally generated heat source as depicted in FIG. 1 of the drawings and when such heat source is an externally generated heat source as depicted in FIG. 2 of the drawings, respectively, renders many things possible that are not possible either in prior art forms of circulating fluidized bed systems or in prior art forms of pulverized coal fired steam generators. By way of exemplification and not limitation in this regard, reference is made herein to the following, which are all deemed to be possible with a heat transfer system constructed in accordance with the present invention, such as the heat transfer system 10 of the present invention that is depicted in FIG. 1: 1) counter flow is possible in all circuits of the heat transfer system 10 constructed in accordance with the present invention; 2) there is no need to replace the tubes (not shown) of the heat transfer surfaces 32 as the temperature drops through the heat transfer system 10 of the present invention; 3) there is no corrosion, erosion or pluggage potential of the tubes (not shown) of the heat transfer surfaces 32 regardless of how bad the solid fuel 16 is; 4) all tubes (not shown) of the heat transfer surfaces 32 can be finned regardless of the properties of the solid fuel 16; 5) all of the tubes (not shown) of the heat transfer surfaces 32 are heated uniformly about the axis of each such individual tube (not shown) by conduction thereby eliminating single side heating of the tubes (not shown) as occurs, for example, with a waterwall form of construction; and 6) greatly enhanced heat transfer due to the fact that the rate of conduction is known to be much greater solids-to-tube than convective heat transfer in gas-to-tube heat transfer.

To complete the description of the heat transfer system 10 of the present invention as illustrated in FIG. 1, note is made here of the fact that the combustion air 18, which is injected into the zone 14 of the vessel 12, before being so injected thereinto is preferably first heated within the air heater 28 by virtue of a heat exchange between the gases, which as denoted by the reference numeral 42 are made to flow through the air heater 28, and the air, which as depicted by the arrow denoted by the reference numeral 44, for this purpose is made to enter and flow through the air heater 28. It is also deemed to be very important to note here that essentially the only air that is employed with the heat transfer system 10 of the present invention in accordance with the best mode embodiment thereof is the combustion air 18 that is injected into the zone 14 of the vessel 12. Moreover, note is also made here that such combustion air 18 is only employed when the heat source that is being utilized is an internally generated heat source. Further to this point, it is deemed to be very important to recognize that no air and/or any gas is injected into the plenum heat exchanger 30 for purposes of effecting therewith a fluidization within the plenum heat exchanger 30 of the downward moving mass of solid particles 24 therewithin. The only other air that is employed with the heat transfer system 10 of the present invention is that which is introduced into each of the plurality of bed drain pipes 31 for purposes of effecting additional classification therewithin between the solid particles 24 and any fines, solid fuel ash and/or sorbent particles that might otherwise enter any one or more of the plurality of bed drain pipes 31.

Turning next to a consideration of FIG. 2 of the drawings, there is depicted therein a heat transfer system, generally designated by the reference numeral 10', constructed in accordance with the present invention, which differs from the heat transfer system 11 that is illustrated in FIG. 1 of the drawings in that whereas in the heat transfer system 10, which is illustrated in FIG. 1, an internally generated heat source is employed in connection therewith, in the heat transfer system 10', which is illustrated in FIG. 2, in contradistinction to the heat transfer system 10, which is illustrated in FIG. 1, an externally generated heat source is employed in connection therewith. For purposes of obtaining an understanding of the mode of operation and of the nature of the construction, of the heat transfer system 10' in accordance with the present invention, which is illustrated in FIG. 2 of the drawings, those components of the heat transfer system 10' that correspond to components of the heat transfer system 10, which are the same as those illustrated in FIG. 1 of the drawings and which have been described hereinbefore in connection with the description of the heat transfer system 10 constructed in accordance with the present invention, are identified in FIG. 2 by the same reference numeral but with a prime being added as a superscript thereto as that which has been employed in FIG. 1 to identify these same components.

Thus, as best understood with a reference to FIG. 2 of the drawings, the heat transfer system 10' includes a first portion, i.e., a vessel, which is generally designated by the reference numeral 12', and which is itself composed of two zones, i.e., a lower zone and an upper zone. The lower zone, generally designated by the reference numeral 14', is operative as the zone in which the externally generated heat source is received, which has been depicted schematically in FIG. 2 of the drawings by the arrow denoted generally by the reference numeral 15. To this end, the externally generated heat source, without departing from the essence of the present invention, may take the form of the hot gas exhaust from a turbine or other similar type of equipment, or could take the form of a hot process stream, which is produced as a consequence of some kind of chemical reaction. In any event, if the externally generated heat source takes the form of a hot gas exhaust, this hot gas exhaust is injected into the lower zone 14' of the first portion 12' as has been depicted schematically in FIG. 2 of the drawings through the use of the arrow denoted by the reference numeral 15. Or, if the externally generated heat source takes the form of a hot process stream, this hot process stream is injected into the lower zone 14' of the first portion 12' as has been depicted schematically in FIG. 2 of the drawings through the use of the arrow denoted by the reference numeral 15.

The upper zone, generally designated by the reference numeral 20', of the vessel 12', i.e., the zone within the vessel 12' that is located above the zone 14', is operative in the manner of a reactor such that a relatively large residence time, on the order of 6 to 7 seconds, is provided whereby a recuperation, to which reference has been had hereinbefore in connection with the description of the heat transfer system 10 that is illustrated in FIG. 1 of the drawings, can occur wherein heat from the externally generated heat source, be such externally heat source in the form of hot exhaust gases or in the form of a hot process stream, such hot exhaust gases or hot process stream undergo an upward flow, as depicted by the arrow denoted by the reference numeral 22', is transferred to a flow of solid particles that are injected, as depicted by the arrowhead denoted by the reference numeral 24', into the upper zone 20' of the vessel 12', and which undergo a downward flow, as depicted by the arrow denoted by the reference numeral 26'. As such, the upper zone 20' of the vessel 12' essentially functions in the manner of a counter flow, direct contact heat exchanger. To this end, no transfer of heat to water/steam takes place in either the zone 14' of the vessel 12' or in the upper zone 20' of the vessel 12'. Accordingly, the walls of the vessel 12' are designed so as to permit them to be refractory lined. Moreover, the solid particles 24' are effective in recuperating the heat from the externally generated heat source, i.e., the hot exhaust gases or the hot process stream, denoted schematically at 22', down to a temperature, which is sufficiently low as to enable the use in the heat transfer system 10' of the present invention of a conventional form of air heater, the latter being schematically depicted in FIG. 2, wherein the said air heater is generally designated by the reference numeral 28'.

In accordance with the preferred embodiment of the invention, the solid particles 24' that are employed for purposes.of effecting therewith the recuperation of the heat from the hot exhaust gases or hot process stream 22' are designed so as to have a high density as well as a.high thermal conductivity. Namely, the higher the density thereof and the greater the number of solid particles 24', i.e., the higher the surface area of the solid particles 24', the smaller the vessel 12' can be. To this end, it has been found that a variety of the forms of bauxite, e.g. Al2O3, are suitable for use as the solid particles 24'. In this regard, not only is this variety of the forms of bauxite, e.g., Al2O3, attractive because of their thermal properties, but in addition because they serve as a raw material for low tech ceramics, they are available in virtually every country of the world. However, it is to be understood that there are other types of particles, embodying the characteristics mentioned above, which such particles should desirably embody, that may also be employed in lieu of the variety of the forms of bauxite mentioned hereinbefore, without departing from the essence of the present invention.

The solid particles 24' that are employed for purposes of effecting therewith the recuperation of the heat from the hot exhaust gases or hot process stream 22' are also designed to have a much higher density and particle size than any matter, which may be entrained in the hot exhaust gases or hot process stream 22' that undergo an upward flow within the vessel 12' after being injected into the lower zone 14' of the vessel 12'. The solid particles 24' are designed to fall downwards through the furnace at the maximum gas velocities within the upper zone 20' of the vessel 12', that is, the terminal velocity of the solid particles 24' within the upper zone 20' of the vessel 12' is greater than the maximum gas velocity within the upper zone 20' of the vessel 12'. The cross-sectional area within the upper zone 20' of the vessel 12' is designed to ensure that the gas velocities therewithin are high enough to entrain most of the matter that may be carried upward with the hot exhaust gases or hot process stream 22' and out of the vessel 12' as denoted by the arrow designated by the reference numeral 36' in FIG. 2 in a manner to which further reference will be had hereinafter.

The solid particles 24' are drained from the lower zone 14' of the vessel 12' in such a manner as to ensure that essentially no fines or coarse matter entrained with the hot exhaust gases or hot process stream 22' is also transferred to the plenum heat exchanger, which is denoted by the reference numeral 30'. In accordance with the best mode embodiment of the present invention, a plurality of bed drain pipes, each of which is denoted in FIG. 2 by the same reference numeral 31' and to which further reference will be had hereinafter, is located such that the inlet of each one of the plurality of bed drain pipes 31', each such inlet being denoted in FIG. 2 by the same reference numeral 31*a*', is located above the floor of zone 14' of the vessel 12'. Through the use of this design, involving the employment of a plurality of bed drain pipes 31' each having an inlet 31*a*' thereof located above the floor, denoted by the reference numeral 14*a*', of zone 14' of vessel 12', no large rocks, etc. are allowed to pass from the zone 14' of the vessel 12' to the plenum heat exchanger 30'. Therefore, such large rocks, etc. are only removable from the vessel 12' by means of a separate bed drain disposal system, the latter being schematically indicated in FIG. 2 by the arrow that is denoted by the reference numeral 33' in FIG. 2.

In a manner to be more fully described herein in connection with the discussion of FIG. 4 in particular of the drawings, air is introduced into each of the plurality of bed drain pipes 31' in a sufficient amount whereby the velocity thereof is high enough to prevent the flow of any matter, which might be entrained with the hot exhaust gases or hot process stream 22', down any one or more of the plurality of bed drain pipes 31', while at the same time the velocity of this air flow is not sufficient enough to impede the downward flow of the solid particles 24' through each one of the plurality of bed drain pipes 31' to the plenum heat exchanger 30'. The air that is introduced into each of the plurality of bed drain pipes 31' is also operative to effect therewith-the combustion of any unburned carbonaceous matter that might enter any one or more of the plurality of bed drain pipes 31'. The heat produced from such combustion is designed to be returned from the respective ones of the plurality of bed drain pipes 31' to the vessel 12'.

Continuing with the description of the heat transfer system 10' of the present invention as depicted in FIG. 2, the heat transfer system 10' constructed in accordance with the present invention further includes a second portion, i.e., the plenum heat exchanger 30' to which reference has been had herein previously. Suitably supported within the plenum heat exchanger 30' in mounted relation therewithin, as will be best understood with reference to FIG. 2, are one or more heat transfer surfaces. In accordance with the illustration in FIG. 2 of the heat transfer system 10' of the present invention, four such heat transfer surfaces, each denoted by the same reference numeral 32' in FIG. 2, are schematically depicted in suitably supported mounted relation within the plenum heat exchanger 30' through the use of any, conventional form of mounting means (not shown in the interest of maintaining clarity of illustration in the drawings) suitable for use for such a purpose, such as preferably to be suitably spaced from each other within the plenum heat exchanger 30'. It is to be understood, however, that a greater or lesser number of such heat transfer surfaces 32' could be employed in the plenum heat exchanger 30' without departing from the essence of the present invention.

Through the plenum heat exchanger 30' there is essentially a simple mass flow of the solid particles 24' that have entered the plenum heat exchanger 30' after flowing through and having been discharged as schematically depicted by the arrowheads, each being denoted by the same reference numeral 35', from the outlet, designated by the reference numeral 31*b*', of each of the plurality of bed drain pipes 31', such that once these solid particles 24' have recuperated within the first portion 20' of the vessel 12' the heat from the externally generated heat source, i.e., from the hot exhaust gases or hot process stream 22', these solid particles 24' move downwardly, primarily under the influence of gravity, at a very low velocity, e.g., on the order of 40 m./hr. As such, these solid particles 24' as they move downwardly take on the characteristics of a moving bed. Although in accordance with the best mode embodiment of the present invention, these solid particles 24' as they move downwardly take on the characteristics of a moving bed, it is to be understood that these solid particles 24' could also move downwardly in some other manner without departing from the essence of the present invention. The important point here is that the heat transfer function be performed, at a minimum, at least partially in a counter flow fashion. To this end, at least part of the heat exchange function must be performed in a counter flow fashion.

In the course of moving downward in the manner to which reference has been had hereinabove, this downward moving mass flow of solid particles 24' flows over the heat transfer surfaces 32', which in accord with the best mode embodiment of the present invention preferably each consists of a plurality of individual tubes (not shown in the interest of maintaining clarity of illustration in the drawings), which when taken collectively comprise a single one of the heat transfer surfaces 32'. Through each of these tubes (not shown) of each of the heat transfer surfaces 32', there flows, as depicted schematically by the arrows that are each labeled with the word "FLUID", the "working fluid" of a cycle. As it is being used here, the term "working fluid" is intended to refer to the "working fluid" of a thermodynamic cycle such as, for example, steam or ammonia, as well as to a process feedstock. The conductive heat exchange that is effected between the downward moving mass flow of solid particles 24' and the working fluid that flows through the tubes (not shown), which when taken collectively comprise one of the heat exchange surfaces 32', is preferably as has been discussed hereinabove one hundred percent counter flow. Although as has also been discussed hereinabove such conductive heat exchange between the downward moving mass flow of solid particles 24' and the working fluid that flows through the tubes (not shown) may alternatively, at a minimum, be at least counter flow.

There exists no necessity therewith to change the spacing between the individual tubes (not shown) that collectively comprise each of the heat exchange surfaces 32', when the fuel employed for purposes of generating therefrom the heat source changes. Further, since there is no flow of gases over the individual tubes (not shown) that collectively comprise each of the heat transfer surfaces 32', there is accordingly no gas side velocity constraints that in gas-to-tube heat exchangers creates the need for multiple sections of superheater, reheater, evaporator and economizer heat transfer surfaces, which most commonly are required in the case of prior art forms of circulating fluidized bed systems as well as in prior art forms of pulverized coal fired steam generators. As such, it is considered to be possible with the heat transfer system 10' of the present invention to provide a single circuit from the economizer inlet thereof to the superheater outlet thereof with the concomitant effect therefrom that header pressure losses are largely eliminated.

In accord with the best mode embodiment of the present invention the solid particles 24' in the plenum heat exchanger 30' consist of virtually one hundred percent bauxite, i.e., $Al_2O_3$, and include only a minimum amount of other matter. This is by virtue of the fact that a classification is effected within the vessel 12' between the solid particles 24' of bauxite, i.e., $Al_2O_3$, and any matter that may have become entrained with the hot exhaust gases or hot process stream 22'. Namely, any matter that may have become entrained with the hot exhaust gases or hot process stream 22' are of micron size and of low density such as to have become entrained in the upward flow of the hot exhaust gases or hot process stream 22'. On the other hand, the solid particles 24' of bauxite, i.e., Al2O3, are very dense and 600 to 1200 microns in size and as such are too large to become entrained in the upward flow of the hot exhaust gases or hot process stream 22'. In addition, the design of the plurality of bed drain pipes 31' coupled with the introduction of air thereinto as has been mentioned hereinabove and to which further reference will be had hereinafter in connection with the discussion of FIG. 4 of the drawings provides additional classification and further ensures that only the solid particles 24' of bauxite, i.e., Al2O3, are passed downwardly to the plenum heat exchanger 30'. Thus, primarily under the influence of gravity the solid particles 24' of bauxite, i.e., Al2O3, move downwardly as has been described hereinabove previously.

With continuing reference to FIG. 2 of the drawings, when the solid particles 24' reach the bottom of the plenum heat exchanger 30', as viewed with reference to FIG. 2, the solid particles 24' are cool enough, i.e., are at a temperature of approximately 500 degrees F. such that the solid particles 24', as indicated schematically by the dotted line generally designated by the reference numeral 34' in FIG. 2 can be transported back to the top of the vessel 12' for injection into the first portion 20' thereof, as has been described hereinabove previously in order to once again repeat the process of the solid particles 24' flowing through the vessel 12' and thereafter through the plenum heat exchanger 30'. This flow of the solid particles 24' within the heat transfer system 10' of the present invention will be referred to herein as the "lower recycle loop".

With further reference to the matter that may become entrained in the hot exhaust gases or the hot process stream 22', as depicted in FIG. 2 of the drawings, wherein an externally generated heat source is employed in connection with the heat transfer system 10', such matter flows upwardly with the hot exhaust gases or the hot process stream 22' from the zone 14' of the vessel 12' into and through the first portion 20' of the vessel 12', and ultimately the hot exhaust gases or the hot process stream 22' with such matter entrained therewith are discharged, as depicted by the arrow denoted by the reference numeral 36' in FIG. 2, to a low temperature, i.e., cold, cyclone of conventional construction, the latter cold cyclone being generally designated by the reference numeral 38' in FIG. 2. Within the cold cyclone 38', in a manner well-known to those skilled in the art the matter that has become entrained with the hot exhaust gases or the hot process stream 22' is separated therefrom. After the separation thereof within the cold cyclone 38', a portion of the matter that has become entrained with the hot exhaust gases or the hot process stream 22', as depicted by the arrow and dotted line generally designated by the reference numeral 40' in FIG. 2, is made to return to the zone 14' of the vessel 12' and with the remainder of such matter being discharged, as depicted by the arrow and dotted line generally designated by the reference numeral 41' in FIG. 2, from the cold cyclone 38' for the eventual disposal thereof. On the other hand, the hot exhaust gases or the hot process stream 22' after having the matter entrained therewith separated therefrom are discharged from the cold cyclone 38' to the air heater 28', as depicted by the arrow and dotted line generally designated by the reference numeral 42' in FIG. 2. The recycle, as described above, of such matter, which may have become entrained with the hot exhaust gases or the hot process stream 22', will be referred to herein as the "upper recycle loop".

The temperature of the plenum heat exchanger 30' is very important because it forms the basis for the conductive heat transfer between the downward moving mass of solid particles 24' and the tubes (not shown) of the heat transfer surfaces 32' and thereby the working fluid that is flowing through these tubes (not shown). In the heat transfer system 10' of the present invention, the temperature within the plenum heat exchanger 30' is a function of the Q fired, the excess air, the upper recycle rate, and the lower recycle rate. For a given Q fired, the independent variables become the upper recycle rate and the lower recycle rate. If it were to become necessary to increase the temperature of the solid particles 24', the lower recycle rate could be reduced, but the exit temperature of the hot exhaust gases or the hot process stream 22' from the first portion 20' of the vessel 12'would increase due to the reduced surface area in which to recuperate the heat from the heat source, i.e., when an externally generated heat source is employed as in the case of the heat transfer system 10' illustrated in FIG. 2 of the drawings, this heat source is the hot exhaust gases or the hot process stream 22'. The upper recycle rate could be reduced to increase the temperature of the solid particles 24', but carbon loss would increase due to the fact that unburned carbonaceous matter, which may have become entrained with the hot exhaust gases or the hot process stream 22' would have fewer opportunities to be recycled from the cold cyclone 38' to the zone 14' of the vessel 12'. Thus, the best strategy is considered to probably be some combination involving an adjustment of each of the two variables, i.e., some adjustment in the lower recycle rate as well as some adjustment in the upper recycle rate.

Collecting in the mass of free flowing solid particles 24 or the solid particles 24' through recuperation the heat from the heat source, when such heat source is an internally generated heat source as depicted in FIG. 1 of the drawings and when such heat source is an externally generated heat source as depicted in FIG. 2 of the drawings, respectively, renders many things possible that are not possible either in prior art forms of circulating fluidized bed systems or in prior art forms of coal fired steam generators. By way of exemplification and not limitation in this regard, reference is made herein to the following, which are all deemed to be possible with a heat transfer system constructed in accordance with the present invention, such as the heat transfer system 10' of the present invention that is depicted in FIG. 2: 1) counter flow is possible in all circuits of the heat transfer system 10' constructed in accordance with the present invention; 2) there is no need to replace the tubes (not shown) of the heat transfer surfaces 32' as the temperature drops through the heat transfer system 10' of the present invention; 3) there is no corrosion, erosion or pluggage potential of the tubes (not shown) of the heat transfer surfaces 32' regardless of the nature of the externally generated heat source that is being employed in connection with the heat transfer system 10'; 4) all tubes (not shown) of the heat transfer surfaces 32' can be finned regardless of the properties of the properties of the hot exhaust gases or the hot process stream 22'; 5) all of the tubes (not shown) of the heat transfer surfaces 32' are heated uniformly about the axis of each such individual tube (not shown) by conduction thereby eliminating single side heating of the tubes (not shown) as occurs, for example, with a waterwall form of construction; and 6) greatly enhanced heat transfer due to the fact that the rate of conduction is known to be much greater solids-to-tube than convective heat transfer in gas-to-tube heat transfer.

To complete the description of the heat transfer system 10' of the present invention as illustrated in FIG. 2, it is deemed to be very important to recognize that no air and/or gas is injected into the plenum heat exchanger 30' for purposes of effecting therewith a fluidization within the plenum heat exchanger 30' of the downward moving mass of solid particles 24' therewithin. The only other air that is employed with the heat transfer system 10' of the present invention is that which in accordance with the best mode embodiment of the present invention is introduced into each of the plurality of bed drain pipes 31' for purposes of effecting additional classification therewithin between the solid particles 24' and any matter that may have become entrained with the hot exhaust gases or the hot process stream 22', which might otherwise enter any one or more of the plurality of bed drain pipes 31'.

Figure 3:
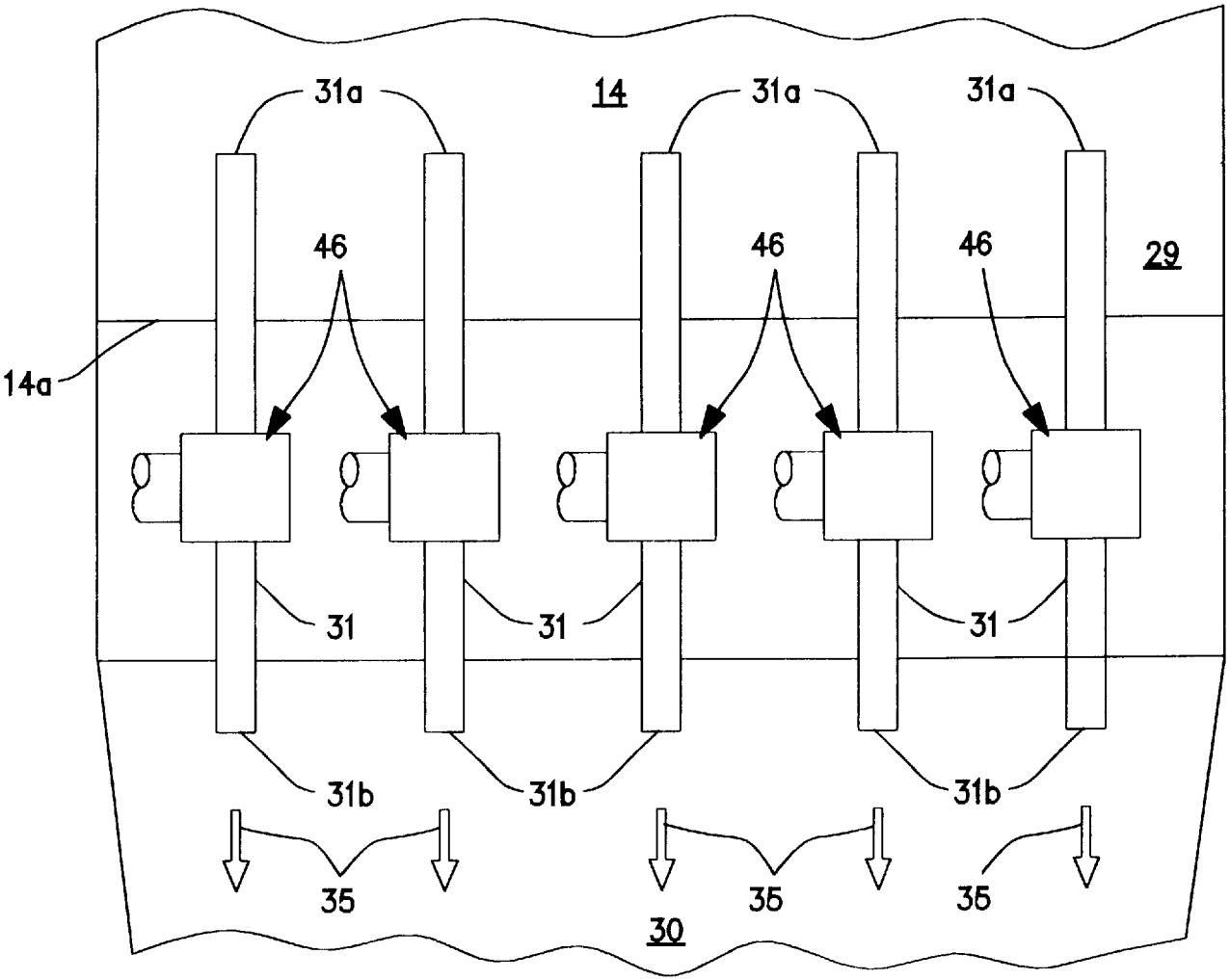
FIG. 3 is a side elevational view on an enlarged scale of the mechanical interconnection, in accordance with the best mode embodiment of the present invention, between the first portion of the heat transfer system of the present invention as illustrated in FIG. 1 and the plenum heat exchanger thereof, which is traversed by the hot solids in going from the first portion to the plenum heat exchanger in accordance with the mode of operation of the heat transfer system of the present invention.

A brief reference will next be-had herein to FIG. 3 of the drawings. To this end, there is depicted in FIG. 3 a side elevational view on an enlarged scale of the mechanical interconnection, in accordance with the best mode embodiment of the invention, between the first portion, i.e., the vessel 12, of the heat transfer system 10 of the present invention as illustrated in FIG. 1 and the plenum heat exchanger 30 thereof, which is traversed by the hot solid particles 24 in going from the vessel 12 to the plenum heat exchanger 30 in accordance with the mode of operation of the heat transfer system 10 of the present invention as illustrated in FIG. 1. More specifically, as best understood with reference to FIG. 3 of the drawings, a mechanical interconnection is effected between the zone 14 of the vessel 12 and the plenum heat exchanger 30 such that there exists a space therebetween, denoted generally in FIG. 3 by the reference numeral 29. Namely, the perimeter encircling the space 29 is closed through the use of any conventional form of means suitable for use for the purpose of effecting therewith the mechanical interconnection of the floor 14*a* of the zone 14 of the vessel 12 with the plenum heat exchanger 30 such that the vessel 12 and the plenum heat exchanger 30 are supported in spaced relation one to another and with the confined space 29 extending therebetween. As has been described hereinbefore in connection with the description of the heat transfer system 10 of the present invention constructed as illustrated in FIG. 1 of the drawings and in connection with the description of the heat transfer system 10' of the present invention constructed as illustrated in FIG. 2 of the drawings, a plurality of bed drain pipes 31 in the case of the heat transfer system 10 illustrated in FIG. 1 of the drawings and a plurality of bed drain pipes 10' in the case of the heat transfer system 10' illustrated in FIG. 2 of the drawings span the confined space 29 such as to comprise the sole means of communication between the zone 14 of the vessel 12 and the plenum heat exchanger 30 in the case of the heat transfer system 10 of the present invention constructed as illustrated in FIG. 1 of the drawings and the sole means of communication between the zone 14' of the vessel 12' and the plenum heat exchanger 30' in the case of the heat transfer system 10' of the present invention constructed as illustrated in FIG. 2 of the drawings. To this end, as best understood with reference to FIG. 3 of the drawings, the plurality of bed drain pipes 31, as shown in FIG. 3 of the drawings, project upwardly through the floor 14*a* of the zone 14 of the vessel 12 such that the inlet 31*a* of each of the plurality of bed drain pipes 31 is located in spaced relation to the floor 14*a* of the zone 14 of the vessel 12. Similarly, the outlet 31*b* of each of the plurality of bed drain pipes 31, as shown in FIG. 3 of the drawings, project inwardly into the plenum heat exchanger 30 such that the outlet 31*b* of each of the plurality of bed drain pipes 31 extends into the plenum heat exchanger 30 to a suitable extent from the confined space 29.

Consideration will next be had herein to FIG. 4 of the drawings wherein there is depicted on an enlarged scale the section of the heat transfer system 10 of the present invention as illustrated in FIG. 1 of the drawings whereat the classification process is performed whereby the heat transfer particles 24, e.g., bauxite, are separated from solid fuel ash, sorbent, combustibles and flue gas. To this end, there is illustrated in FIG. 4 of the drawings a portion of the floor 14*a* of the zone 14 of the vessel 12, and a portion of the upper, as viewed with reference to FIG. 4, surface, generally designated by the reference numeral 30*a* in FIG. 4, of the plenum heat exchanger 30. In addition, depicted in FIG. 4 by way of exemplification is a single one of the plurality of bed drain pipes 30, having its inlet 31 a located within the zone 14 of the vessel and in suitably spaced relation to the floor 14*a*, and its outlet 31*b* located within the plenum heat exchanger 30 and in suitably spaced relation to the upper surface 30*a* of the plenum heat exchanger.

Referring again to FIG. 4 of the drawings, as shown therein there is mounted, in accordance with the best mode embodiment of the present invention, in surrounding relation to the bed drain pipe 31, which is depicted in FIG. 4, so as to be suitably spaced from both the floor 14*a* of the zone 14 of the vessel 12 and the upper surface 30*a* of the plenum heat exchanger 30 is a classification means, generally denoted by the reference numeral 46 in FIG. 4. Any conventional form of mounting means (not shown in the interest of maintaining clarity of illustration in the drawings) suitable for effecting the mounting of the classification means 46 in surrounding relation to the bed drain pipe 31 may be utilized for this purpose. As best understood with reference to FIG. 1 of the drawings, in accordance with the best mode embodiment of the present invention a classification means 46 preferably is cooperatively associated with each one of the plurality of bed drain pipes 31 such that the number of individual classification means 46 corresponds to the number of individual bed drain pipes 31 that are employed in the heat transfer system 10 of the present invention constructed as illustrated in FIG. 1 of the drawings. In a similar fashion, as best understood with reference to FIG. 2 of the drawings, in accordance with the best mode embodiment of the present invention a classification means 46' preferably is cooperatively associated with each one of the plurality of bed drain pipes 31' such that the number of individual classification means 46' corresponds to the number of individual bed drain pipes 31' that are employed in the heat transfer system 10' of the present invention constructed as illustrated in FIG. 2 of the drawings. However, it is to be understood that a lesser number of classification means 46 than the number of individual bed drain pipes 31 could be employed in the heat transfer system 10 of the present invention without departing from the essence of the present invention, and that similarly a lesser number of classification means 46' than the number of individual bed drain pipes 31' could be employed in the heat transfer system 10' of the present invention without departing from the essence of the present invention.

Continuing, as best understood with reference to FIG. 4 of the drawings, the classification means 46 comprises an essentially circular member, denoted by the reference numeral 48 in FIG. 4, to which a tubular-like member, denoted by the reference numeral 50 in FIG. 4, is suitably affixed at one end thereof, through the use of any form of conventional means suitable for such purpose, with the other end of the tubular-like member 50 being connected to a suitable source of air (not shown) such that air is permitted to flow through a suitable manifold-like means (not shown in the interest of maintaining clarity of illustration in the drawings) into and through the tubular-like member 50 to the circular member 48 and therefrom in surrounding relation to the bed drain pipe 31 whereupon such air is made to enter the bed drain pipe 31 through a plurality of openings, which are depicted through the use of phantom lines in FIG. 4 and which are each denoted in FIG. 4 for ease of reference thereto by the same reference numeral 52, that are provided for this purpose in suitably spaced relation one to another around the circumference of the bed drain pipe 31. A greater or a lesser number of openings 52 from that depicted in phantom lines in FIG. 4 could be employed without departing from the essence of the present invention. The air after entering the bed drain pipe 31 through the openings provided around the circumference of the bed drain pipe 31 for this purpose flows upwardly through the bed drain pipe 31 into the zone 14 of the vessel 12. The amount of air that is introduced in the aforesaid manner into the bed drain pipe 31 is designed to be such that the velocity of this air is high enough to prevent the flow of undesired matter, such as fines, solid fuel ash and sorbent particles, from flowing downwardly from the zone 14 of the vessel 12 through the bed drain pipe 31 into the plenum heat exchanger 30, while at the same time the velocity of this air flow is not sufficient enough to impede the downward flow of the solid particle s24 from the zone 14 of the vessel 12 through the bed drain pipe 31 into the plenum heat exchanger 30.

Thus, in accordance with the present invention there has been provided a new and improved design for a heat transfer system that is predicated upon the employment therefor of a new and novel approach insofar as heat transfer systems are concerned. In addition, there has been provided in accord with the present invention such a new and improved heat transfer system that is characterized by its low cost. As well, in accordance with the present invention there has been provided such a new and improved heat transfer system that is characterized by the fact that solids enhanced heat transfer is capable of being realized therewith. Moreover, there has been provided in accord with the present invention such a new and improved heat transfer system that is characterized by the fact that there is a complete decoupling of the combustion, heat transfer and environmental control processes. Besides, in accordance with the present invention there has been provided such a new and improved heat transfer system that is characterized by the fact that by virtue of the complete decoupling therewith of the combustion, heat transfer and environmental control processes, it thus enables each of these processes to be separately optimized. Plus, there has been provided in accord with the present invention such a new and improved heat transfer system that is characterized by the fact that the heat transfer solids, e.g., bauxite, are effectively separated from the solid fuel ash, sorbent, combustibles, and flue gas in a classification step before these heat transfer solids are caused to flow to a heat transfer means. Moreover, in accordance with the present invention there has been provided such a new and improved heat transfer system that is characterized by the fact that such a heat transfer system is not affected by changing fuel properties, be the fuel a solid, a liquid or a gas by virtue of the existence of the classification process employed therewith whereby only the heat transfer solids, e.g., bauxite, are in contact with the heat transfer means. Further, there has been provided in accord with the present invention such a new and improved heat transfer system that is characterized by the fact that to the extent that an internal heat source is employed in connection with such a new and improved heat transfer system there is thus no heat transfer surface embodied in the area of the internal heat source. Furthermore, in accordance with the present invention there has been provided such a new and improved heat transfer system that is characterized by the fact that such a heat transfer system nevertheless still retains the capability to effect therewith a minimization of NOx emissions. Also, there has been provided in accord with the present invention such a new and improved heat transfer system that is characterized by the fact that therewith sulfur capture is decoupled from the combustion process. Additionally, in accordance with the present invention there has been provided such a new and improved heat transfer system that is characterized by the fact that in accordance with the best mode embodiment thereof the need for a fluidized bed heat exchanger is eliminated therewith with the concomitant benefits being derived as a consequence thereof that auxiliary power is reduced and the cost of blowers and ductwork associated therewith is avoided, although it is still possible with such a new and improved heat transfer system to have a fluidized bed design wherein external heat transfer surface is followed by a counter current section at one end thereof. Penultimately, there has been provided in accord with the present invention such a new and improved heat transfer system that is characterized by the fact that it is possible therewith to employ a cold cyclone in lieu of a hot cyclone, the latter being what is customarily more generally required to be utilized. Finally, in accordance with the present invention there has been provided such a new and improved heat transfer system that is advantageously characterized in that such a heat transfer system is relatively inexpensive to provide, while also being relatively simple in construction.

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. A heat transfer system operative to effect therewith the heating of a working fluid by means of the transfer of heat from hot regenerative solids to the working fluid comprising:

a. a first portion having a lower zone and an upper zone;

b. a source of heat provided in said lower zone of said first portion, said source of heat being movable upwardly within said first portion from said lower zone thereof to said upper zone thereof;

c. a multiplicity of regenerative solids provided in said upper zone of said first portion, said multiplicity of regenerative solids each having a density and a particle size sufficient enough that the terminal velocity of each of said multiplicity of regenerative solids within said first portion is greater than the maximum upward velocity of said source of heat within said first portion, said multiplicity of regenerative solids being movable downwardly within said first portion from said upper zone thereof to said lower zone thereof such that said multiplicity of regenerative solids become heated as a result of the recuperation thereby of the heat possessed by said source of heat as said source of heat moves upwardly within said first portion from said lower zone thereof to said upper zone thereof while concomitantly said multiplicity of regenerative solids move downwardly within said first portion from said upper zone thereof to said lower zone thereof;

d. a second portion mechanically interconnected to said first portion;

e. bed drain pipe means extending from within said lower zone of said first portion to within said second portion and having an inlet located at one end thereof and an outlet located at the other end thereof, said bed drain pipe means having said one end thereof projecting into said lower zone of said first portion so as to have said inlet thereof located within said lower zone of said first portion and having said other end thereof projecting into said second portion so as to have said outlet thereof located within said second portion such that said multiplicity of regenerative solids enter said bed drain pipe means from said lower zone of said first portion and flow downwardly through said bed drain pipe means whereupon said multiplicity of regenerative solids exit from said bed drain pipe means and then flow in the manner of a moving bed downwardly through said second portion;

f. classification means cooperatively associated with said bed drain pipe means for substantially preventing undesired matter from flowing downwardly from said lower zone of said first portion through said bed drain pipe means into said second portion; and g. heat exchanger means supported in mounted relation within said second portion, said heat exchanger means having a working fluid flowing therethrough, said heat exchanger means being operative such that as said working fluid flows therethrough said working fluid becomes heated as said multiplicity of regenerative solids flow in the manner of a moving bed downwardly through said second portion in surrounding relation to said heat exchanger means while said multiplicity of regenerative solids become cooled as a consequence of a conductive heat transfer between said multiplicity of regenerative solids that have become heated in said first portion and said working fluid flowing through said heat exchanger means.

2. The heat transfer system as set forth in claim 1 wherein said source of heat is internally generated within said lower zone of said first portion.

3. The heat transfer system as set forth in claim 1 wherein air and solid fuel are each injected into said lower zone of said first portion, said air and said solid fuel are then subjected to combustion within said lower zone of said first portion, and said source of heat is internally generated within said lower zone of said first portion from the heat produced from the combustion of said air and said solid fuel within said lower zone of said first portion.

4. The heat transfer system as set forth in claim 1 wherein said source of heat is generated externally of said lower zone of said first portion.

5. The heat transfer system as set forth in claim 4 wherein said source of heat generated externally of said lower zone of said first portion comprises the hot exhaust gases from a turbine, said hot exhaust gases thereafter being introduced into said lower zone of said first portion.

6. The heat transfer system as set forth in claim 4 wherein said source of heat generated externally of said lower zone of said first portion comprises a hot process stream produced as a consequence of some form of chemical reaction, said hot process stream thereafter being introduced into said lower zone of said first portion.

7. The heat transfer system as set forth in claim 1 wherein said multiplicity of regenerative solids comprise particles of bauxite.

8. The heat transfer system as set forth in claim 1 wherein said classification means is connectable to an external source of air and is operative to introduce into said bed drain pipe means an amount of air sufficient enough such that the velocity of said air is high enough to prevent undesired matter from flowing downwardly from said lower zone of said first portion through said bed drain pipe means into said second portion.

9. The heat transfer means as set forth in claim 8 wherein said classification means comprises at least one circular member mounted in surrounding relation to said bed drain pipe means and at least one tubular-like member having one end thereof affixed to said at least one circular member and the other end thereof connectable to an external source of air, said at least one tubular-like member being operative to supply air from the external source of air to said at least one circular member.

10. The heat transfer means as set forth in claim 1 wherein said bed drain means includes at least one pair of bed drain pipes supported in spaced relation one to another so as to each extend from within said lower zone of said first portion to within said second portion, said at least one pair of bed drain pipes each having an inlet located at one end thereof and an outlet located at the other end thereof, said at least one pair of bed drain pipes each having said one end thereof projecting into said lower zone of said first portion so as to have said inlet thereof located within said lower zone of said first portion and each having said other end thereof projecting into said second portion so as to have said outlet thereof located within said second portion such that said at least one pair of bed drain pipes is operative to effect the conveyance of said multiplicity of regenerative solids from said lower zone of said first portion into said second portion.

11. The heat transfer system as set forth in claim 10 further comprising classification means connectable to an external source of air and cooperatively associated with said bed drain pipe means, said classification means comprising at least one pair of circular members and at least one pair of tubular-like members, said at least one pair of circular members each being mounted in surrounding relation to one of said at least one pair of bed drain pipes, said at least one pair of tubular-like members each having one thereof affixed to a corresponding one of said at least one pair of circular members and each having the other end thereof connectable to an external source of air, said at least one pair of tubular-like members each being operative to supply air from the external source of air to the one of said at least one pair of circular members to which said one end thereof is affixed.

12. The heat transfer system as set forth in claim 1 wherein said heat exchanger means comprises a working fluid and a plurality of heat transfer surfaces supported in spaced relation to one another within said heat exchanger means, each of said plurality of heat transfer surfaces having the working fluid flowing therethrough such that as the working fluid flows through each one of said plurality of heat transfer surfaces the working fluid becomes heated as said multiplicity of regenerative solids flow in the manner of a moving bed downwardly though said second portion in surrounding relation to each one of said plurality of heat transfer surfaces while said multiplicity of regenerative solids become cooled as a consequence of a conductive heat transfer between said multiplicity of regenerative solids and the working fluid flowing through each one of said plurality of heat transfer surfaces.

13. The heat transfer system as set forth in claim 12 wherein the working fluid flowing through each one of said plurality of heat transfer surfaces is steam.

14. The heat transfer system as set forth in claim 12 wherein the working fluid flowing through each one of said plurality of heat transfer surfaces is ammonia.

15. The heat transfer system as set forth in claim 12 wherein the working fluid flowing through each one of said plurality of heat transfer surfaces is a process feedstock.

16. The heat transfer system as set forth in claim 1 wherein said second portion includes discharge means for discharging said multiplicity of regenerative solids from said second portion and said upper zone of said first portion includes receiving means for receiving said multiplicity of regenerative solids.

17. The heat transfer system as set forth in claim 16 further comprising recycle means interconnecting said discharge means of said second portion and said receiving means of said upper zone of said first portion, said recycle means being operative to recycle said multiplicity of regenerative solids from said discharge means of said second portion to said receiving means of said upper zone of said first portion.

* * * * *